US008850856B2

(12) United States Patent
Leibman et al.

(10) Patent No.: US 8,850,856 B2
(45) Date of Patent: Oct. 7, 2014

(54) APPARATUS AND METHOD FOR USING A DISPENSING SYSTEM UTILIZING A VENTURI COMPONENT

(75) Inventors: Alexander Leibman, Prospect, KY (US); Alaknanda Acharya, Hyderabad (IN); David Scott Dunn, Smithfield, KY (US); Jerrod Aaron Kappler, Louisville, KY (US); Aaron Lee Welch, Louisville, KY (US)

(73) Assignee: General Electric Company, Schenectady, NY (US)

( * ) Notice: Subject to any disclaimer, the term of this patent is extended or adjusted under 35 U.S.C. 154(b) by 850 days.

(21) Appl. No.: 12/969,973

(22) Filed: Dec. 16, 2010

(65) Prior Publication Data

US 2012/0151970 A1 Jun. 21, 2012

(51) Int. Cl.

| | |
|---|---|
| ***D06F 29/00*** | (2006.01) |
| ***D06F 33/00*** | (2006.01) |
| ***D06F 35/00*** | (2006.01) |
| ***D06F 39/00*** | (2006.01) |

(52) U.S. Cl.

CPC ..... *D06F 39/00* (2013.01)
USPC ..... 68/12.18; 68/3 R; 68/17 R

(58) Field of Classification Search

None
See application file for complete search history.

(56) References Cited

U.S. PATENT DOCUMENTS

| | | | | |
|---|---|---|---|---|
| 3,756,457 | A | 9/1973 | Holmes et al. | |
| 3,982,666 | A * | 9/1976 | Kleimola et al. | 222/651 |
| 4,090,475 | A | 5/1978 | Kwan | |
| 4,434,629 | A * | 3/1984 | Bianchi et al. | 68/13 A |
| 6,301,734 | B1 | 10/2001 | Dunsbergen et al. | |
| 6,401,499 | B1 | 6/2002 | Clark et al. | |
| 7,036,175 | B2 | 5/2006 | Sears et al. | |
| 7,481,081 | B2 | 1/2009 | Hsu et al. | |
| 2006/0272360 | A1 | 12/2006 | Hsu et al. | |
| 2007/0261177 | A1 | 11/2007 | Risen et al. | |
| 2009/0095027 | A1 | 4/2009 | Deppermann et al. | |
| 2009/0095750 | A1 | 4/2009 | Vitan et al. | |
| 2009/0288454 | A1* | 11/2009 | Lee et al. | 68/17 R |
| 2010/0205753 | A1* | 8/2010 | Kim et al. | 8/137 |

FOREIGN PATENT DOCUMENTS

WO 2010/026516 A1 3/2010

* cited by examiner

*Primary Examiner* — Jason Ko
(74) *Attorney, Agent, or Firm* — Global Patent Operation; Douglas D. Zhang

(57) ABSTRACT

An apparatus is provided herein. The apparatus includes, a clothes basket rotatable about an axis, a motor coupled to the clothes basket, an additive tank, a Venturi component comprising a hole connecting to a water inlet, a hole connecting to the additive tank, and a hole connecting to the clothes basket, a first valve, a second valve, and a processor coupled to the first valve and the second valve, the processor being operative to carry out a dispensing phase of the apparatus, wherein the dispensing phase comprises dispensing additive to the clothes basket, and carry out a self-cleaning phase of the apparatus, wherein the self-cleaning phase comprises washing the additive tank.

15 Claims, 23 Drawing Sheets

APPARATUS AND METHOD FOR USING A DISPENSING SYSTEM UTILIZING A VENTURI COMPONENT

CROSS-REFERENCE TO RELATED APPLICATIONS

The present application is related to U.S. patent application entitled "Apparatus and Method for Utilizing a Venturi Effect in a Dispenser," identified by application Ser. No. 13/075,417, filed Mar. 30, 2011.

BACKGROUND OF THE INVENTION

The subject matter disclosed herein relates to appliances such as washing machines, and more particularly to dispensing systems and the like.

Any bulk dispenser (such as, for example, a clothes washer) necessarily uses a pump to dispense additive, which is expensive and consumes energy. Also, there can be a problem of clogging associated with pumps. Additionally, the dispensing tube that carries additive alone can develop sticking in the inner wall of the tube, and after some time duration, if the washing machine is not in use, the tube can become clogged because of the accumulated additive. Further, debris formation takes place in some duration of time in the event that's the user rarely cleans the tank, which is common because in existing approaches the user is required to remove the tank for cleaning.

BRIEF DESCRIPTION OF THE INVENTION

As described herein, the example embodiments of the present invention overcome one or more disadvantages known in the art.

One aspect relates to an apparatus comprising: a clothes basket rotatable about an axis; a motor coupled to the clothes basket; an additive tank; a Venturi component, wherein the Venturi component comprises a hole connecting to a water inlet, a hole connecting to the additive tank, and a hole connecting to the clothes basket; a first valve, wherein the first valve is located between the water inlet and the Venturi component; a second valve, wherein the second valve is located between the Venturi component and the clothes basket; and a processor coupled to the first valve and the second valve. The processor is operative to carry out one or more of the aforementioned methods.

Another aspect relates to an apparatus comprising: a clothes basket rotatable about an axis; a motor coupled to the clothes basket; an additive tank; a Venturi component, wherein the Venturi component comprises a hole connecting to a water inlet, a hole connecting to the additive tank, and a hole connecting to the clothes basket; a first valve, wherein the first valve is located between the water inlet and the Venturi component; a second valve, wherein the second valve is located between the water inlet and the additive tank; and a processor coupled to the first valve and second valve. The processor is operative to carry out one or more of the aforementioned methods.

Another aspect relates to an apparatus comprising a Venturi component for use in a washing machine apparatus, wherein the component comprises a water inlet hole, wherein the water inlet hole connects to a water inlet of the washing machine apparatus; an additive inlet hole, wherein the additive inlet hole connects to an additive tank; and an outlet hole, wherein the outlet hole connects to a clothes basket of the washing machine apparatus; wherein water flows through the water inlet hole, creating a vacuum in the additive inlet hole, resulting in suction of additive from the additive tank which mixes with the water passing through the water inlet hole and is carried through the outlet hole to the clothes basket of the washing machine apparatus.

Yet another aspect of the present invention relates to a method of operating a washing machine system comprising the steps of: opening a first valve, wherein opening the first valve allows water to flow into the washing machine system, facilitating the water to flow through a Venturi component, creating a vacuum in an area of the Venturi component connected to a dispensing hose connected to an additive tank, resulting in suction of additive from the additive tank through the dispensing hose, facilitating, via the Venturi component, the additive to be mixed with the water in the Venturi component and carried to a clothes basket of the washing machine system, and opening a second valve when a predetermined level of additive in the additive tank is reached, wherein the second valve regulates water flow into and through a nozzle hose to clean the additive tank.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more embodiments of the invention provide a method and/or apparatus to implementing a dispensing system utilizing a Venturi component. It should be noted, as detailed herein, that a Venturi component, an aspirator, an eductor, and a jet pump are largely interchangeable terms, as used herein.

Figure 1:
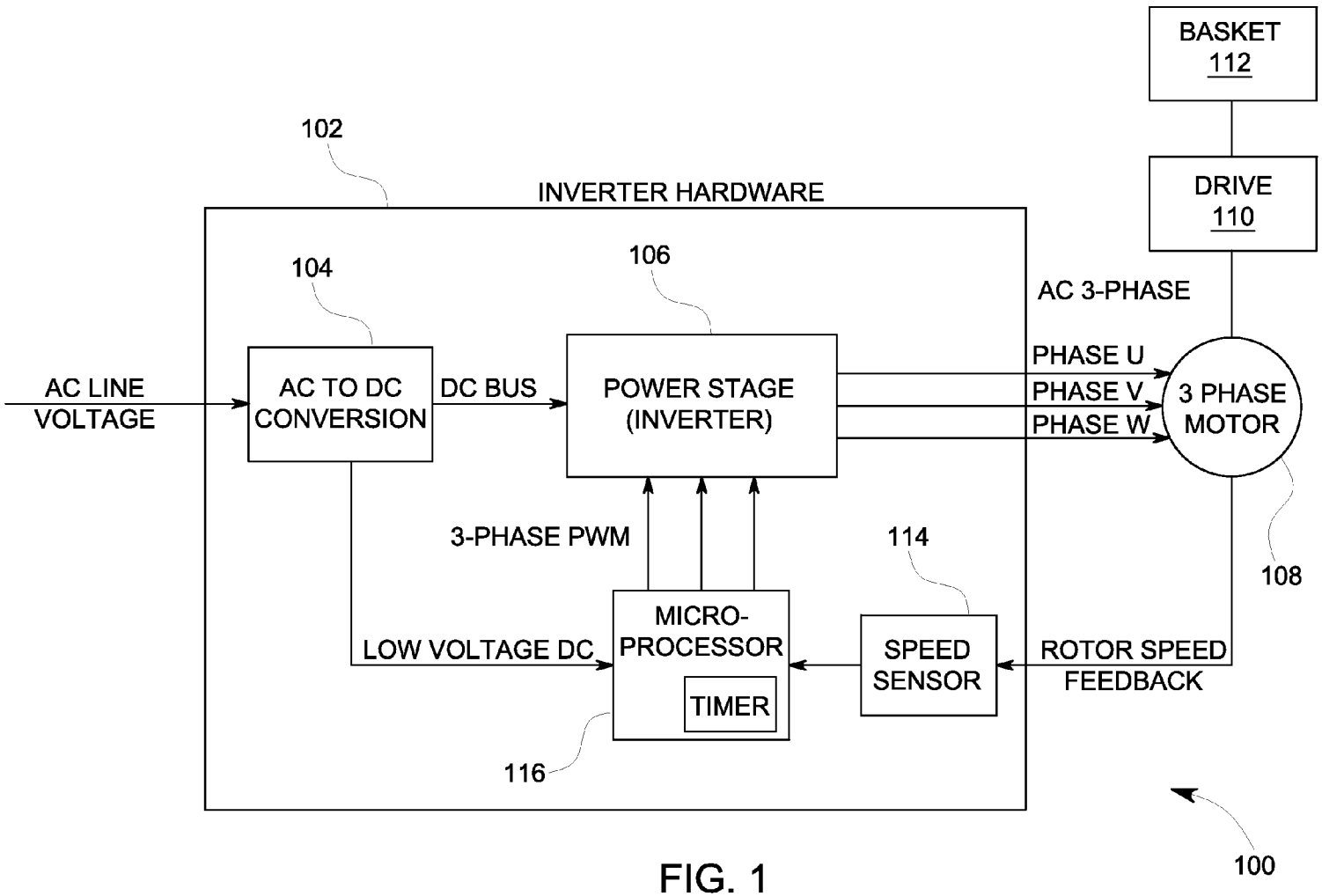
FIG. 1 is a block diagram of an example system, in accordance with a non-limiting example embodiment of the invention.

Reference should now be had to block diagram 100 of FIG. 1. Alternating current (AC) line voltage is supplied to inverter hardware 102. The AC is converted to direct current (DC) in block 104 using a rectifier or the like. Relatively high voltage DC is provided to a DC power bus and then to inverter 106 to provide 3-phase AC to 3-phase motor 108. Relatively low voltage DC is provided to microprocessor 116 which can include a suitable timer (not separately numbered). Motor 108 is coupled to basket 112 for receiving clothes to be washed, with a suitable drive 110. While in theory there could be a direct coupling, in practice, a suitable reduction arrangement is preferably employed, such as a pulley and belt arrangement, gearing, or the like, wherein basket 112 turns at a lower revolutions per minute (RPM) than motor 108. In a specific non-limiting example, the reduction is about 13.2 such that the RPM of basket 112 must be multiplied by 13.2 to obtain the motor shaft speed. Unless otherwise noted, the RPM values given herein are for the basket 112. A suitable sensor 114 is employed to provide feedback regarding the basket RPM value (or motor RPM value, since the relationship between the two is known based on the reduction of drive 110) to microprocessor 116. Microprocessor 116 is programmed, for example, with suitable software or firmware, to implement one or more techniques as described herein. In other embodiments, an application-specific integrated circuit (ASIC) or other arrangement could be employed.

The skilled artisan will be familiar with conventional washer systems and given the teachings herein will be enabled to make and use one or more embodiments of the invention; for example, by programming a microprocessor 116 with suitable software or firmware.

As used herein, a clothes washer refers to a system with a rotating clothes container. The axis of rotation of the clothes container may be substantially vertical (e.g., top load), substantially horizontal (e.g., front load), or may even have an intermediate value. Typically, the system will include washing and spinning cycles, but one or more embodiments are applicable to systems with only a spin cycle; e.g., an extraction machine. As noted, the rotational speed (angular velocity) of the basket (clothes container) 112 and/or the motor 108 is a significant parameter. It may be specified in RPM, radians per second, and so on.

Figure 2:
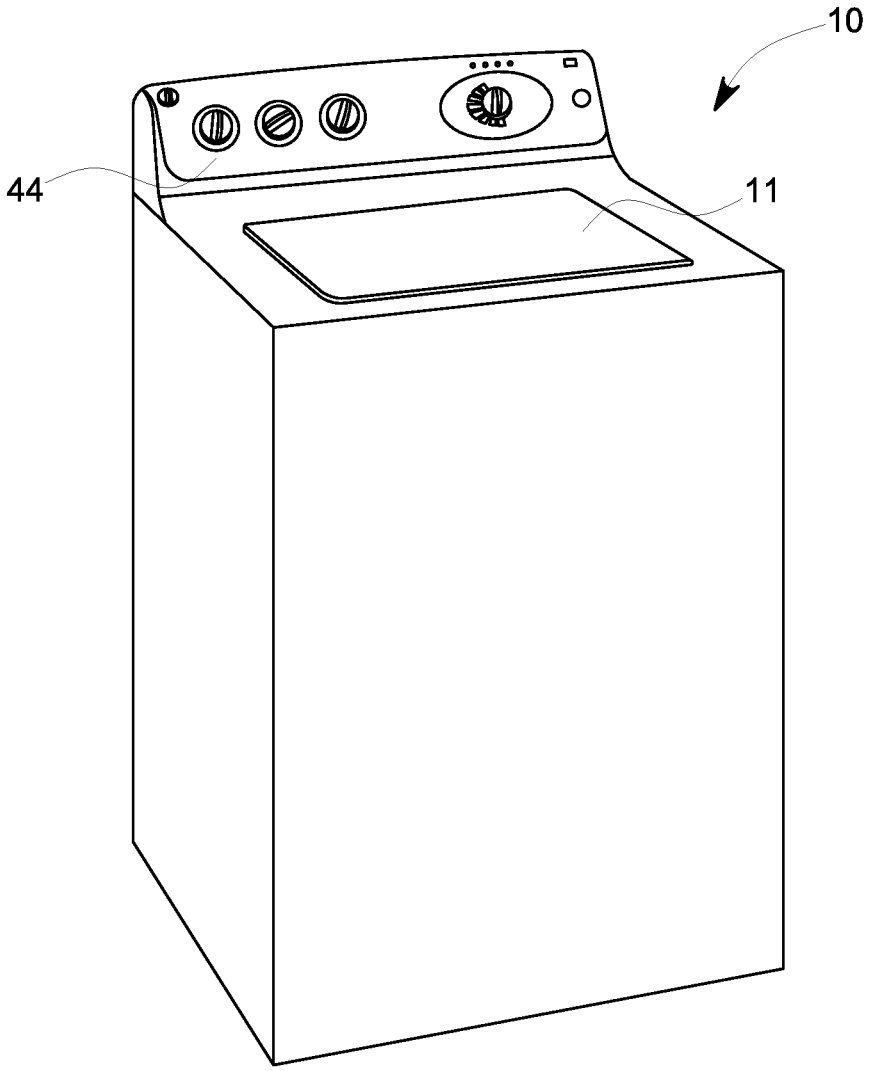
FIG. 2 is a pictorial view of an example top-loading washing machine.

FIG. 2 shows an example top-loading washing machine 10 including a control panel or portion 44 and a loading door 11. Machine 10 is a non-limiting example of a machine with which one or more aspects of the invention may be implemented.

Figure 3:
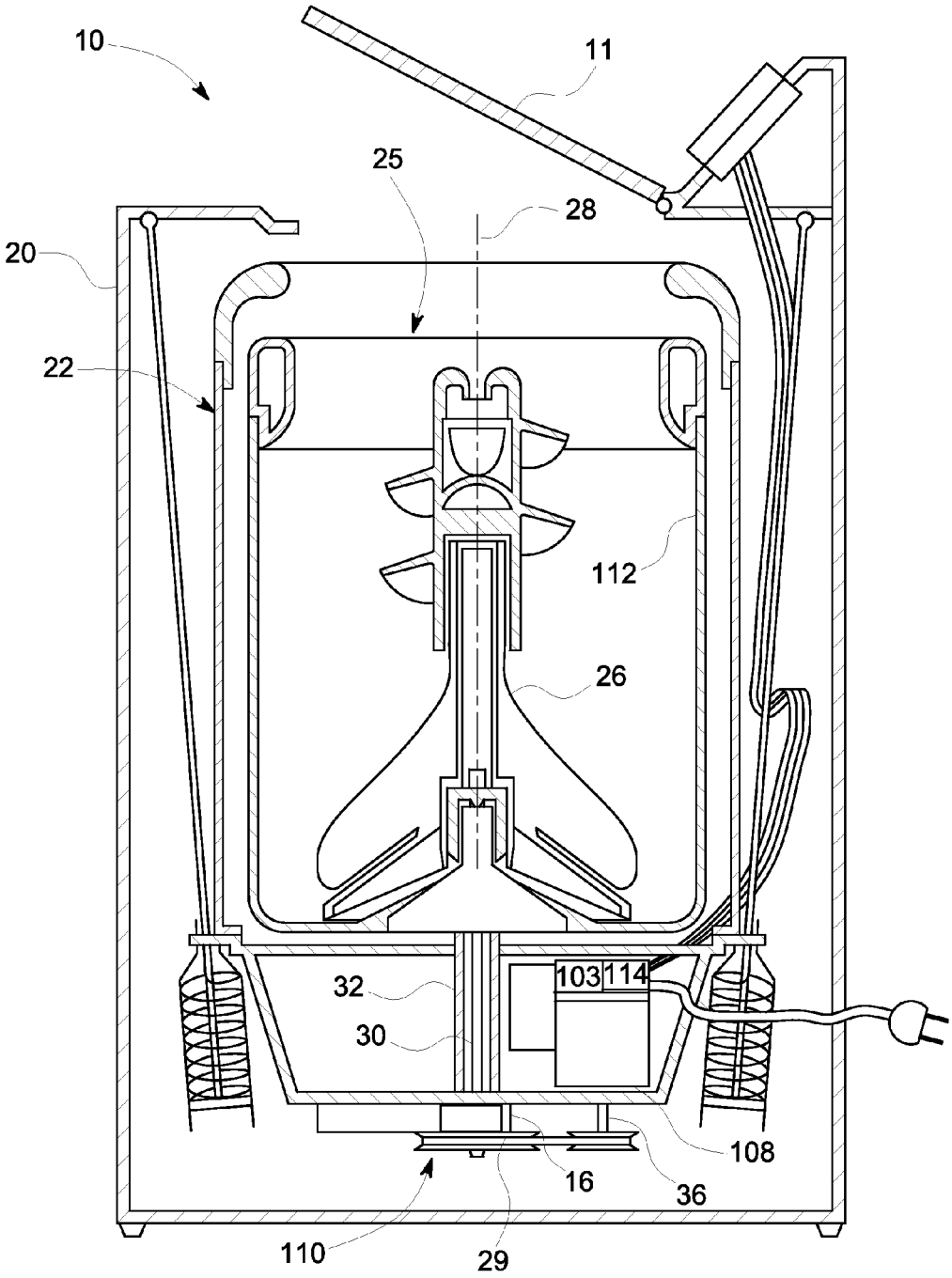
FIG. 3 is a cross-sectional side elevation of an example top-loading washing machine similar to that depicted in FIG. 2.

FIG. 3 shows a cross-sectional side elevation of an example top-loading washing machine 10 similar to that depicted in FIG. 2. Clothes are loaded through door 11 into clothes-receiving opening 25. The machine has an external cabinet 20. A structure 22 is suspended with springs (not separately numbered) and includes basket 112 and agitator 26 revolving about axis 28. The basket 112 is driven by motor 108 via drive arrangement 110; in this case, the latter includes a pulley mounted to motor drive shaft 36 connected by belt 29 to a pulley mechanically linked to basket driveshaft 30 and spin tube 32, which are concentric shafts. Driveshaft 30 is directly coupled to the pulley and belt 29, and drives the agitator. Spin tube 32 is directly coupled to the basket 112. A clutch locks elements 30 and 32 together during spin. Speed sensor 114 is provided on motor driveshaft 36. Motor 108 is controlled by a control unit 103 which may include components such as 104, 106, and 116. As would be appreciated by one skilled in the art, FIG. 3 serves merely as an example, and, as such, additional and/or separate embodiments can be implemented in connection with the invention (such as, for example, the use of an impeller, a direct drive motor, etc.). Additionally, one or more embodiments of the invention can be implemented with additional types of motors such as, a permanent magnet, a direct drive motor, or any motor driven by an inverter.

Figure 5:
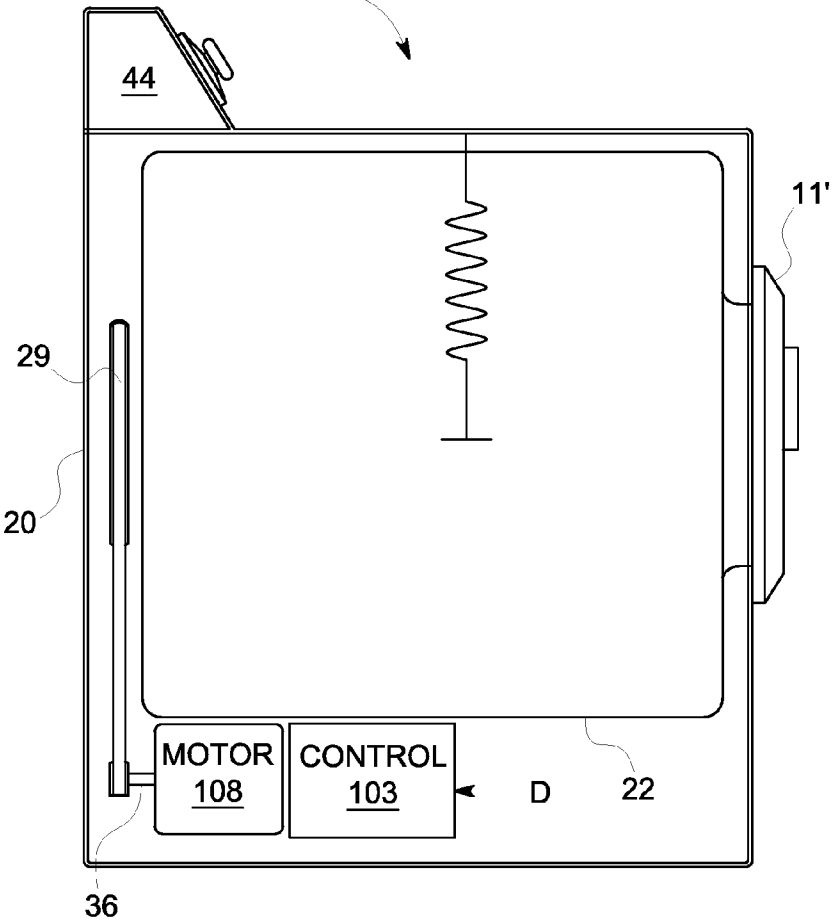
FIG. 5 is a semi-schematic cross-sectional side elevation taken along line VIII-VIII of FIG. 4.
Figure 4:
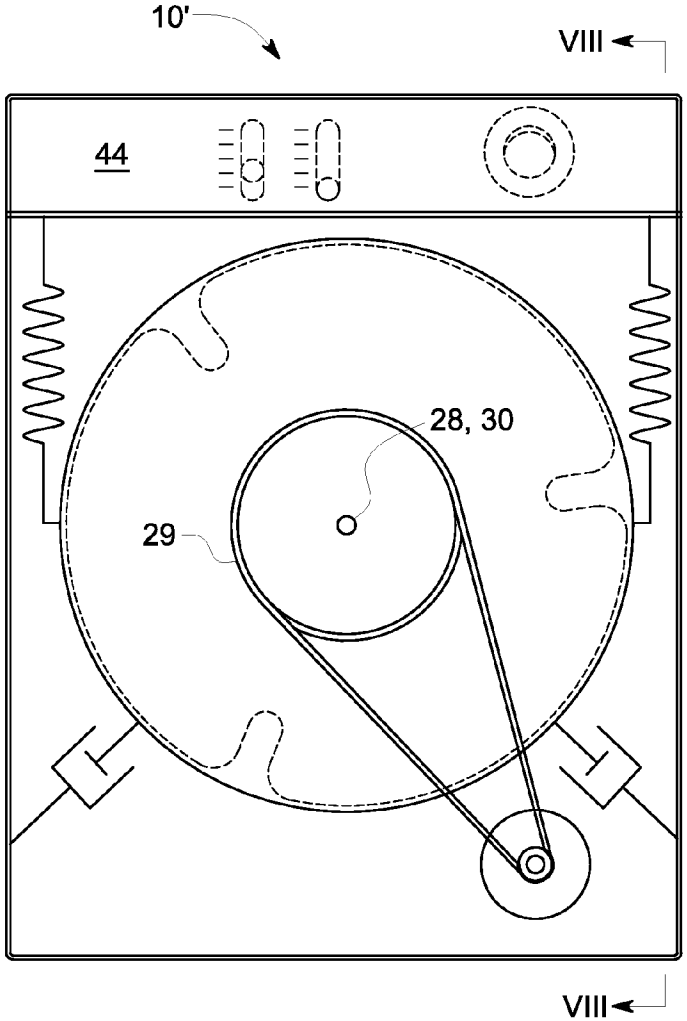
FIG. 4 is a semi-schematic rear elevation of an example front-loading washing machine.

FIG. 4 is a semi-schematic rear elevation of an example front-loading washing machine 10' and FIG. 5 is a semi-schematic cross-sectional side elevation taken along line VIII-VIII of FIG. 4. Machine 10' is another non-limiting example of a machine with which one or more aspects of the invention may be implemented. Clothes are loaded through door 11'. The machine has an external cabinet 20 and a control panel or portion 44. A structure 22 is suspended with springs and dampers (not separately numbered) and may include a basket and agitator revolving about axis 28. The basket is driven by motor 108 via a drive arrangement; in this case, the latter includes a pulley mounted to motor drive shaft 36 connected to a pulley mounted to basket driveshaft 30 by belt 29. A speed sensor can be provided. Motor 108 is controlled by a control unit 103 which may include components such as 104, 106, and 116.

One or more embodiments can be implemented in the software or firmware that controls microprocessor 116 and drives the motor 108 for the washing machine.

As described herein, one or more embodiments of the invention include techniques and apparatuses for implementing a dispensing system utilizing a Venturi component. One or more embodiments of the invention include a self-cleaning system utilizing the Venturi effect to deliver additives into the washing machine. A vacuum created by a Venturi component placed in the way of inlet water flow can be used to deliver additive from a tank. One or more embodiments of the invention can apply to cups/flow-through dispensers and tank/bulk dispensers, as well as apply to both top-loaded and front-loaded machines.

In one or more embodiments of the invention, a dispensing system can include an additive tank connected with the vacuum area of a Venturi component through a dispensing hose extending down in the indentation at the bottom of tank. Also, in one or more embodiments of the invention, one end of the Venturi component is connected to the water inlet and the other end is connected to the tub through hoses. By way of example, based on the signal from controls, Valve1 (FIG. 6) can turn ON allowing water flow for a certain duration of time. Thus, water flows through the Venturi component creating a vacuum in a known area where a dispensing hose is connected, resulting in suction of additive in the tank through dispensing hose, which is then carried by water to the tub. One or more embodiments of the invention can also include a liquid level sensor that indicates to a user to fill the tank if the additive level falls below a predefined value.

Additionally, one or more embodiments of the invention can include a self-cleaning cycle, which can be activated by a user or performed automatically (for example, every time the tank is empty). By way of example, in one or more embodiments of the invention, a user can be prompted to press multiple buttons to enable this cycle in order to avoid selection of this cycle by mistake. The self-cleaning portion of dispensing system can include an additional valve (for example, Valve2), which is operated by controls to turn ON/OFF the water flow through nozzle hose. The nozzle hose can be connected to the nozzle secured in the wall of the additive tank. The tank can also have a pipe with holes or a channel for dispensing water from above along the walls of the tank.

Figure 6:
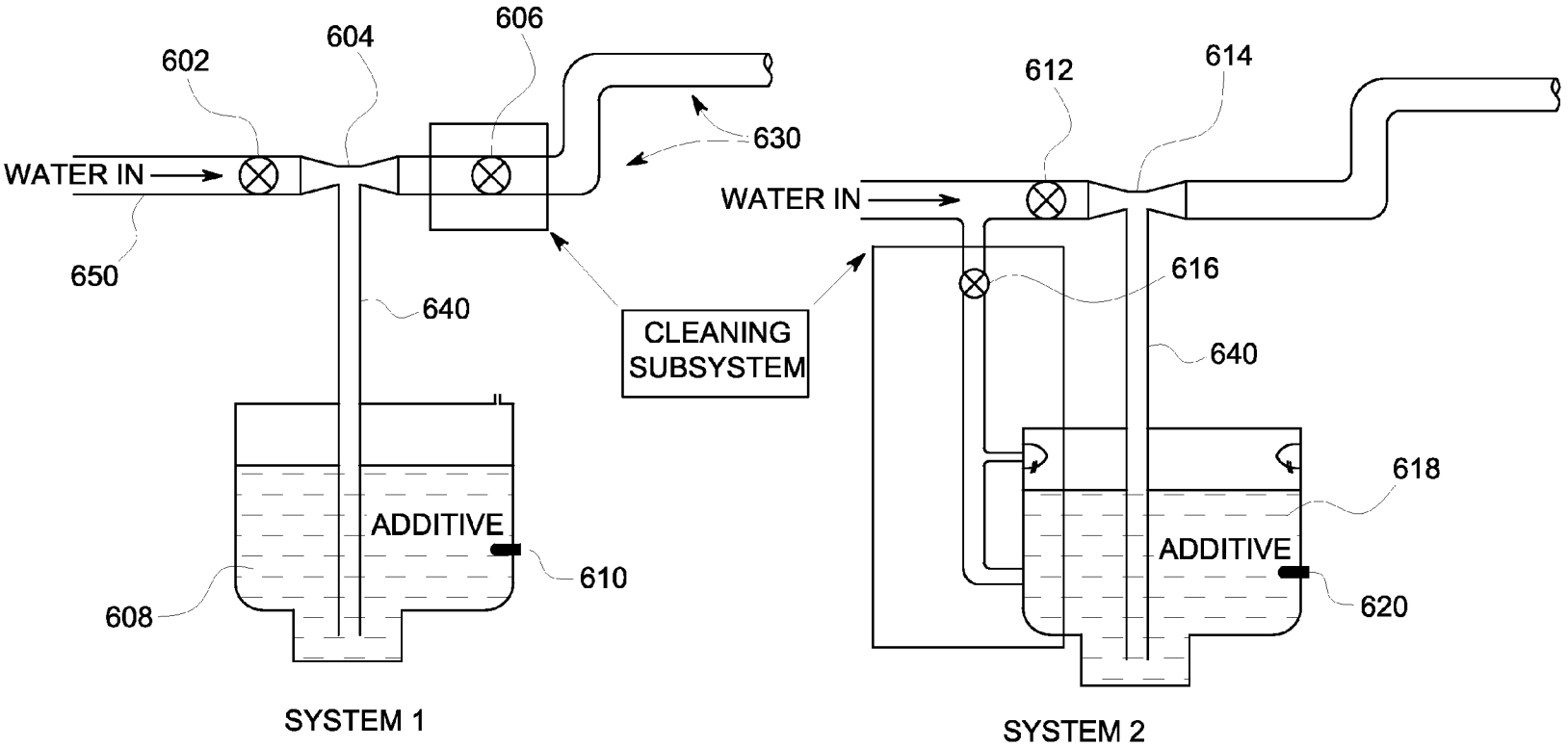
FIG. 6 presents two self-cleaning dispensing systems, in accordance with a non-limiting example embodiment of the invention.

By way of example, when a user selects the self-clean cycle in system2, as illustrated in FIG. 6, Valve1 turns ON/open, and due to the Venturi effect, removes any additive in the system until the low level is reached, which the liquid level sensor senses. Once the low level is reached, Valve2 turns ON/open the water flow in the nozzle hose and water jets through the nozzle to clean the entire tank.

In one or more embodiments of the invention, there can be different combinations of Valve1 and Valve2 ON/OFF states for optimum cleaning of a system. For example, Valve1 can remain open when Valve2 is open to drain out the wastewater simultaneously as the cleaning takes place, or Valve1 can immediately close when Valve2 opens, giving time to clean all of the areas of additive tank, and then open after a certain duration of time to remove the wastewater. Additionally, this process can be repeated for a desired cleaning performance.

As described herein, use of a Venturi effect to dispense additive is a cost effective solution. Additionally, for example, with clogging being a primary contributor to a number of customer complaints related to bulk dispensers, one or more embodiments of the invention include use of an additive-water mixture that is dispensed in the tub, and further include a self-clean cycle that can clean the system without requiring a user to remove tanks, thereby avoiding the clogging problem. Also, in one or more embodiments of the invention, the Venturi component has no moving part, is compact, requires no lubrication, seals or electricity, and is easy to clean and maintain.

As detailed herein, one or more embodiments of the invention include two self-cleaning dispensing systems having a similar dispensing method, that is, through a Venturi effect, but with different self-clean systems. FIG. 6 presents two self-cleaning dispensing systems, in accordance with a non-limiting example embodiment of the invention. By way of illustration, System 1 includes a first valve 602, a Venturi component 604, a second valve 606, a tank 608 and a liquid level sensor 610. Similarly, System 2 includes a first valve 612, a Venturi component 614, a second valve 616, a tank 618 and a liquid level sensor 620. As further detailed below, for example, one point of distinction between the two systems is that both valves in System 2 can have water going through them.

With regards to System 1, there is a tank 608 (for example, a large tank, such as a I-gallon capacity tank), and this tank sits inside of the washing machine. The user/consumer can, by way of example, pour one gallon of additive such as detergent/fabric softener/etc. into the tank 608. Additionally, in one or more embodiments of the invention, there is a part, for example, a 1/4-inch in diameter tube, coming out of the tank 608, and at the end of this tube or part there is a Venturi component 604, which can be a hollow piece (for example, of plastic, metal, glass, ceramic, etc.) with three holes. If water is pumped through the Venturi component, the water passing through creates a vacuum which attracts the additive from the tank 608, and it flows into the washing machine (basically, from the left to the right in the FIG. 6 illustration). Further along in the system, there are a tube and a basket in the tube with dirty clothes. The water/additive mixture will be delivered into the basket with (dirty) cloths to wash. The cleaning of the tank 608 can be performed when, for example, the tank 608 is almost empty and the washing machine contains no cloths to wash. The cleaning of the tank 608 is performed by closing valve #2 (that is, valve 606 in FIG. 6) and opening valve #1 (that is, valve 602 in FIG. 6), allowing the water to fill the tank 608. By opening valve #2 (and valve #1), the dirty water can be sucked out into the basket of the washing machine and pumped out by the drain pump. System 2, shown on FIG. 6, can be cleaned by opening both valve 612 and valve 616.

Figure 7:
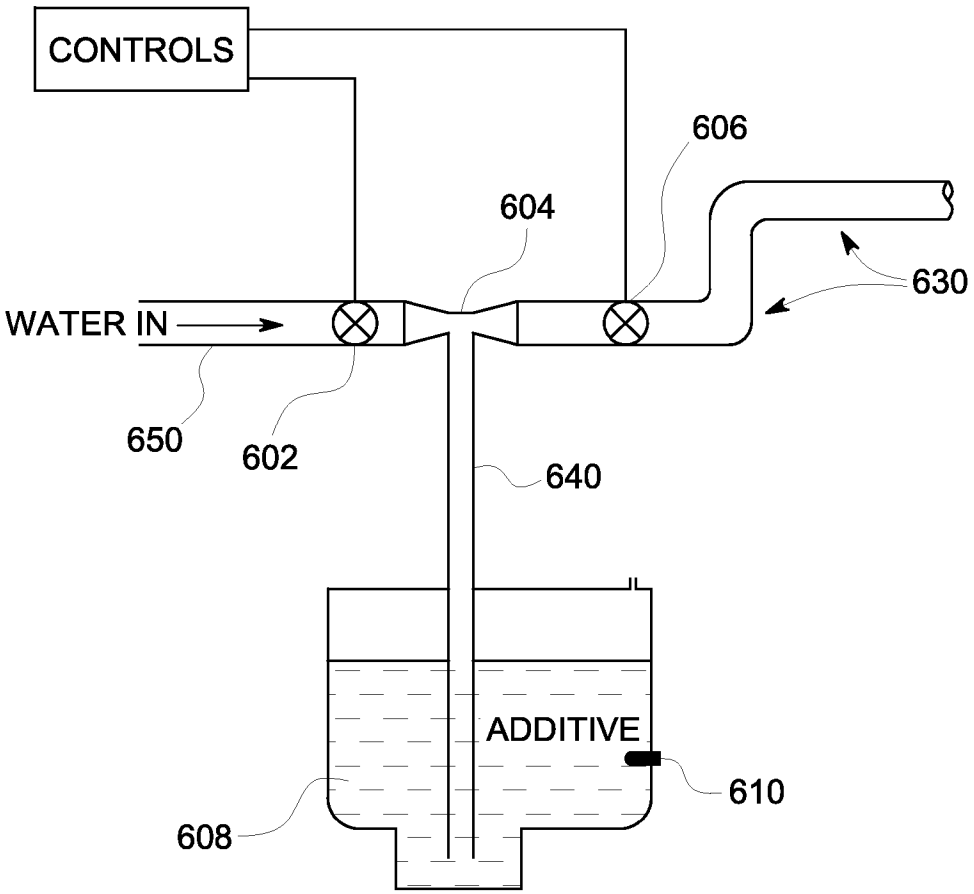
FIG. 7 presents a default phase of a first system, in accordance with a non-limiting example embodiment of the invention.

FIG. 7 presents a default phase of System 1, in accordance with a non-limiting example embodiment of the invention. As illustrated, FIG. 7 depicts the additive tank 608 (which includes liquid level sensor 610) connected with the vacuum area of Venturi component 604 through a dispensing hose 640 extending down in an indentation at the bottom of tank 608 (for example, to keep residual cleaning water to a minimum). One end of the Venturi component 604 is connected to the water inlet 650 (the water inlet herein refers to the flow connection that is upstream of the Venturi component 604 or 614 and contains the valve 602 or 612) and other end is connected to the tub through hoses. The additive tank 608 is filled with additive, and the first valve 602 and the second valve 606 both are in "closed" position (controlled by controls) and no water is flowing through the system in this phase. As also depicted in FIG. 7 (and elsewhere), in one or more embodiments of the invention, one or more flow restrictions (for example, two elbows 630) in the system can create back pressure in (for example, to prime) the system.

Figure 8:
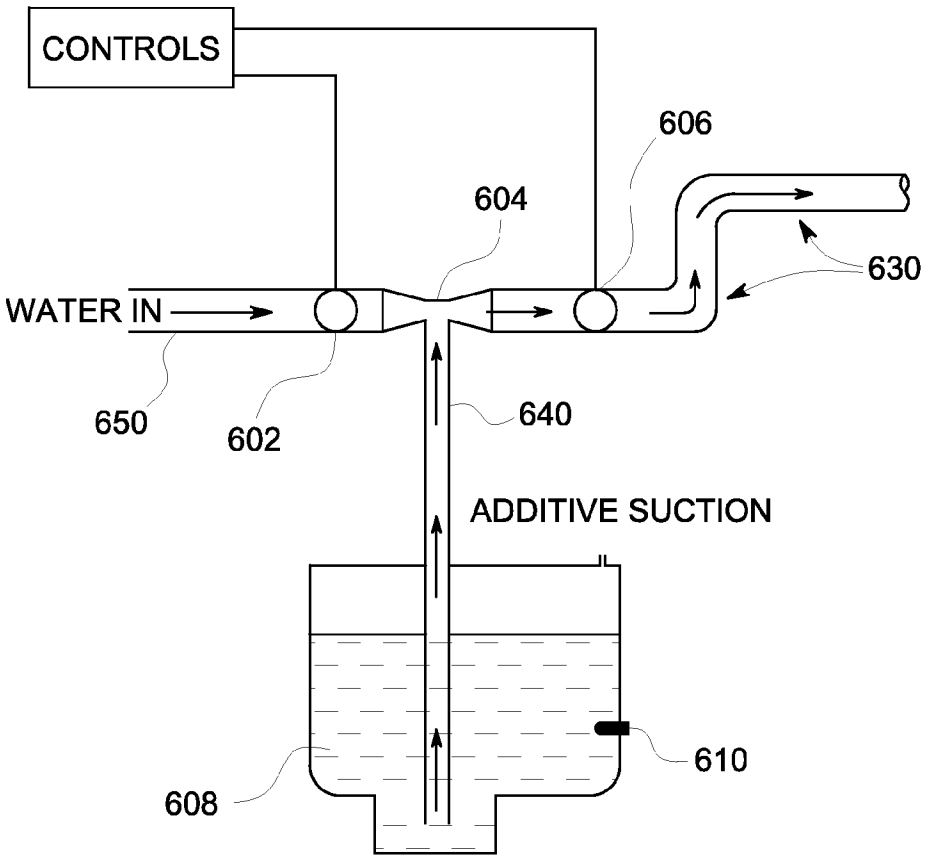
FIG. 8 presents a dispensing phase of a first system, in accordance with a non-limiting example embodiment of the invention.

FIG. 8 presents a dispensing phase of System 1, in accordance with a non-limiting example embodiment of the invention. As depicted in FIG. 8, based on the signal from controls, the first valve 602 and the second valve 606 open, allowing water flow for a certain time duration. Thus, water flows through the Venturi component 604 creating a vacuum in a known area where the dispensing hose 640 is connected, thus resulting in suction of additive in the tank 608 through the dispensing hose 640, which is then carried by water to the tub.

Figure 9:
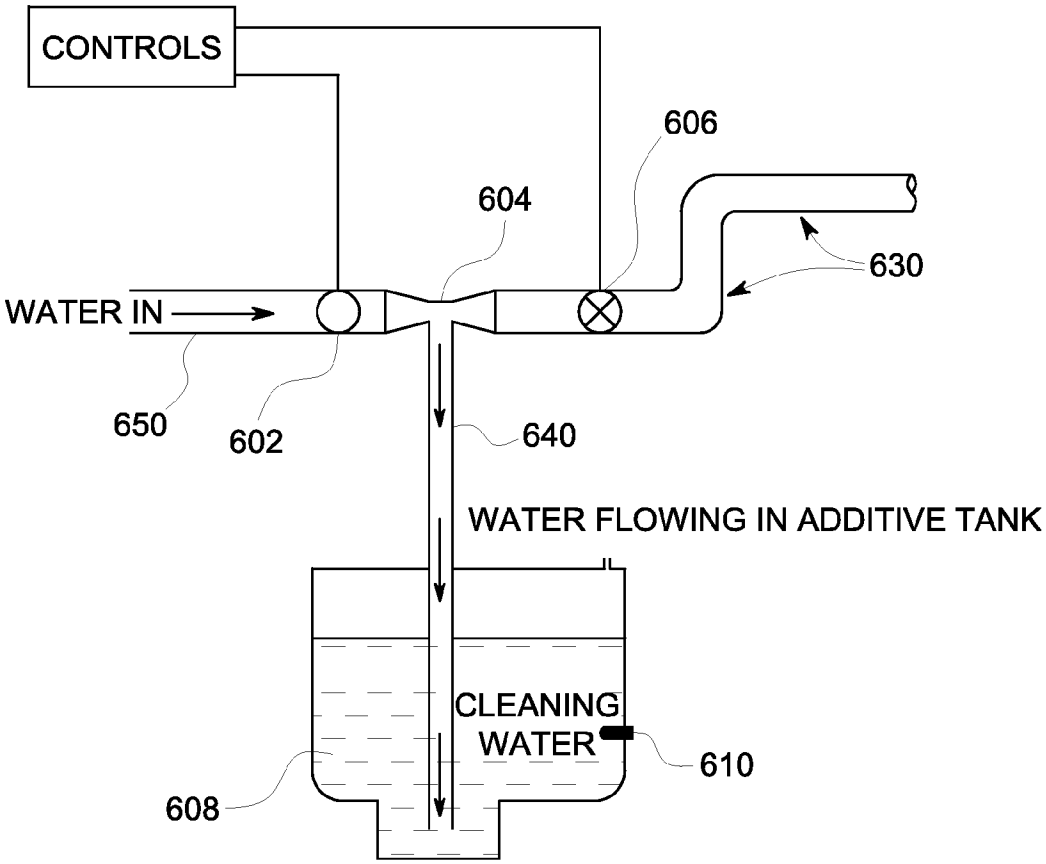
FIG. 9 presents a self-cleaning phase of a first system, in accordance with a non-limiting example embodiment of the invention.

FIG. 9 presents a self-cleaning phase of System 1, in accordance with a non-limiting example embodiment of the invention. When a user selects the self-clean cycle, the first valve 602 and the second valve 606 open and, due to the Venturi effect, remove any additive in the system until the low level is reached which the liquid level sensor 610 senses. Once the low level is reached, the second valve 606 closes and the water flows in additive tank 608 through the dispensing hose 640, thus cleaning it. After a specific time, the second valve 606 can open to allow waste-water removal from tank 608 through the Venturi effect and again close to fill the tank 608 for cleaning. This process can be repeated to ensure optimum level of cleanliness of dispensing system.

One or more embodiments of the invention can also include a system such as System 2 (from FIG. 6). One difference from System 1 is the cleaning sub-system, which is used to wash the tank 618, for example, after the gallon of detergent is used. As such, System 2 has a cleaning sub-system, and if the cleaning valve is opened, water is going to go into the tank 618 to wash the tank 618.

Figure 10:
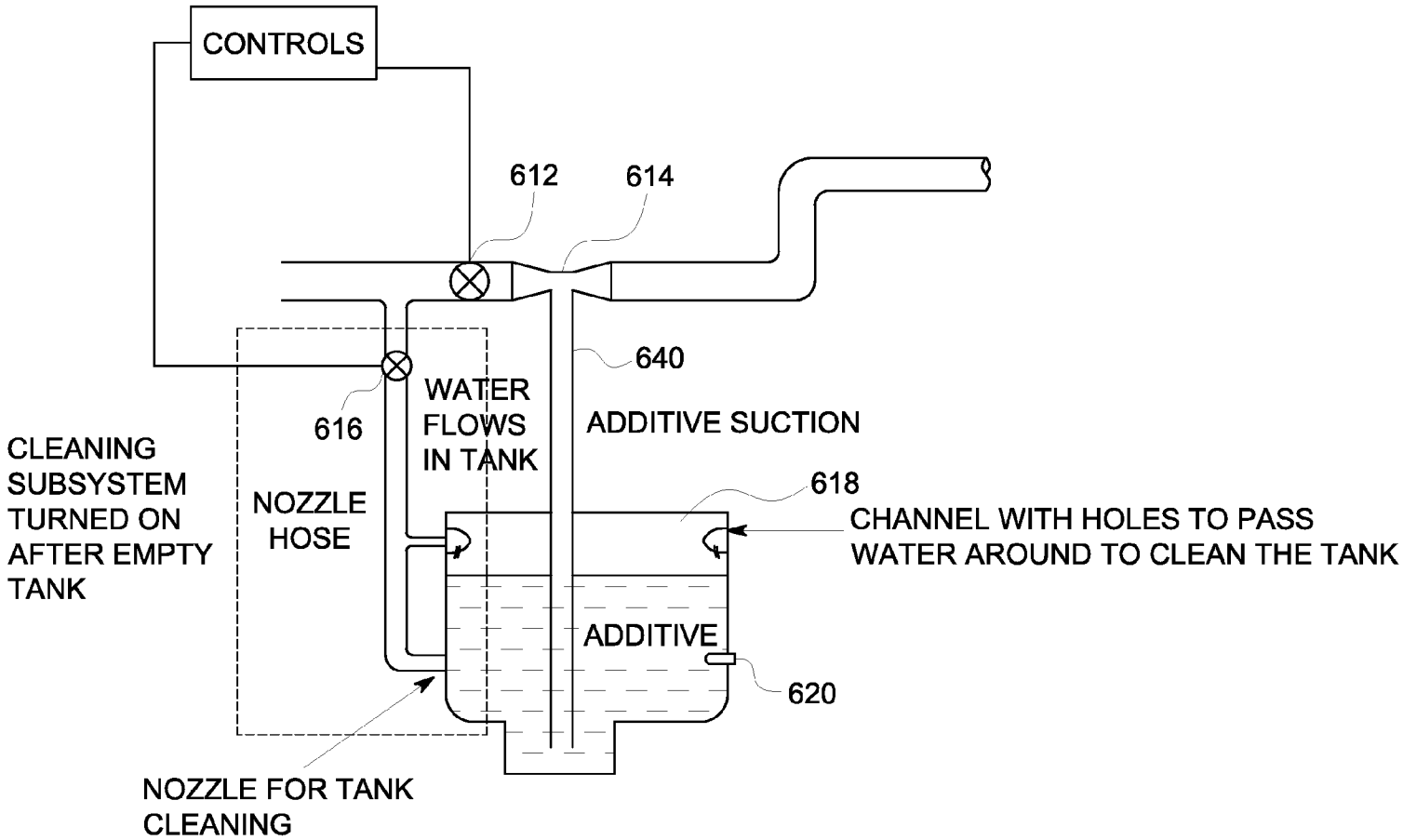
FIG. 10 presents a default phase of a second system, in accordance with a non-limiting example embodiment of the invention.

FIG. 10 presents a default phase of System 2, in accordance with a non-limiting example embodiment of the invention. As depicted in FIG. 10, additive tank 618 is connected with the vacuum area of Venturi component 614 through a dispensing hose 640 extending down in the indentation at the bottom of tank 618. The tank 618 can also include a channel with holes to pass water around (for example, to clean the tank). One end of the Venturi component 614 is connected to the water inlet and other end is connected to the tub through hoses. In the illustration of FIG. 10, the additive tank 618 is filled with additive, the first valve 612 is in "close" position and no water is flowing through the system in this phase. FIG. 10 also depicts the cleaning subsystem (which can be turned on, for example, after the tank 618 is almost emptied) which includes valve 616 (which is closed at this stage in this embodiment), a nozzle hose and a nozzle for tank cleaning.

Figure 11:
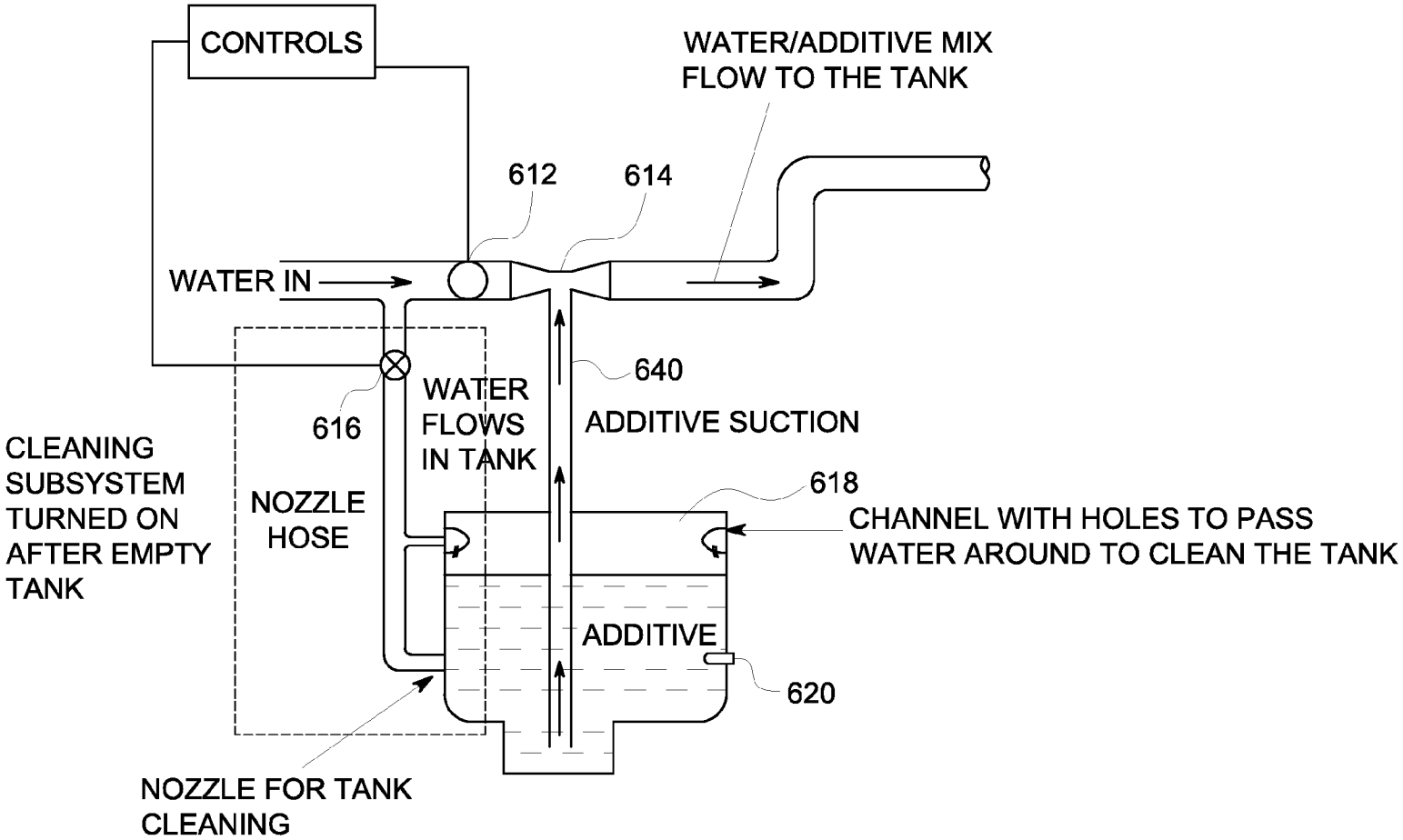
FIG. 11 presents a dispensing phase of a second system, in accordance with a non-limiting example embodiment of the invention.

FIG. 11 presents a dispensing phase of the second system, in accordance with a non-limiting example embodiment of the invention. In the example illustrated in FIG. 11, based on the signal from controls, the first valve 612 turns ON/opens, allowing water flow for a certain time duration. Thus, water flows through the Venturi component 614, creating vacuum in a known area where the dispensing hose 640 is connected, thus resulting in suction of additive in the tank 618 through the dispensing hose 640, which is then carried by water to the tub. As also noted herein, this system can additionally include a liquid level sensor 620 that indicates user to fill the tank 618 if an additive level falls below a predefined value. At this stage in this embodiment, valve 616 remains closed.

Figure 12:
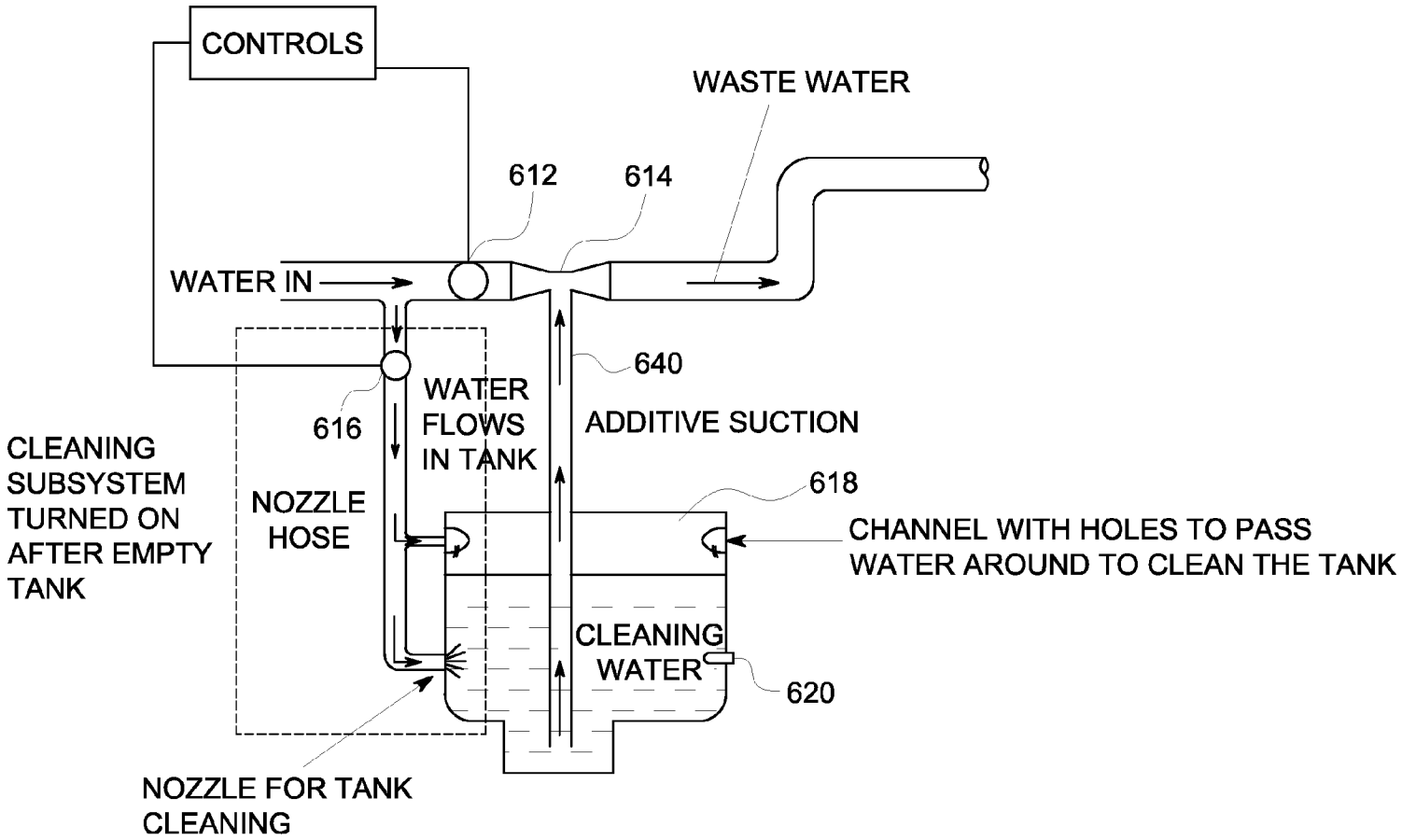
FIG. 12 presents a self-cleaning phase in a second system, in accordance with a non-limiting example embodiment of the invention.

FIG. 12 presents a self-cleaning phase in a second system, in accordance with a non-limiting example embodiment of the invention. In the self-cleaning stage, valve 616 is operated by controls to turn ON the water flow through a nozzle hose. The nozzle hose is connected to a nozzle secured in the wall of additive tank 618. The tank 618 also has a pipe/channel with holes dispensing water from above along the walls of the tank 618.

When a user selects the self-clean cycle, the first valve 612 turns ON/opens and, due to the Venturi effect, removes any additive in the system until the low level is reached which the liquid level sensor 620 senses. Once the low level is reached, the second valve 616 turns ON/opens the water flow in the nozzle hose, and the water through the nozzle cleans the tank 618.

In one or more embodiments of the invention, there can be different combinations of valve 612 and valve 616 ON/OFF states for optimum cleaning of a system. The first valve 612 can remain open when the second valve 616 is open to drain out the waste-water simultaneously as the cleaning takes place, or the first valve 612 can immediately close when valve 616 opens, giving time to clean all of the areas of the additive tank and opens after certain duration of time to remove the waste-water. Also, this process can be repeated to provide desired cleaning performance.

One difference between System 1 and System 2 is that valve 606 on System 1 can, in one or more embodiments of the invention, always have a detergent/water mixture going through it. Valve 606 is normally in the OPEN condition. However, in some conditions such as, for example, when the system is being cleaned, valve 606 is turned off; that way, when valve 602 is opened, the only direction the water can go is into the tank. Then, valve 606 can be opened again to suck out the water (of a mostly water—somewhat water/detergent mixture) through valve 606. Additionally, in System 2, both valves 614 and 616 can only have water going through them.

Figure 13A:
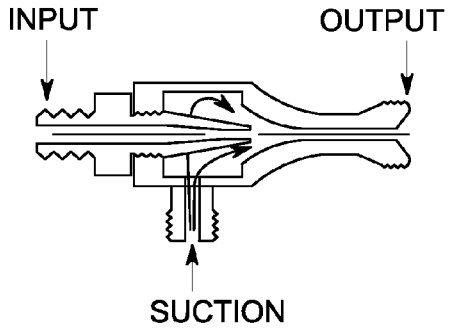
FIG. 13A presents an example eductor pump.
Figure 13B:
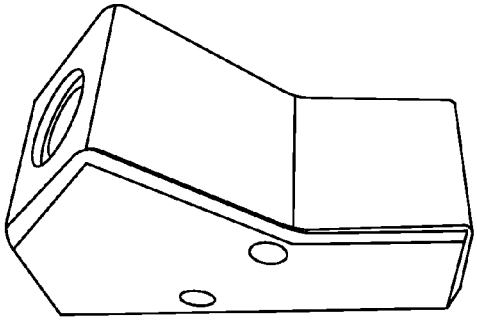
FIG. 13B presents a view of an example Venturi component, in accordance with a non-limiting example embodiment of the invention.
Figure 13C:
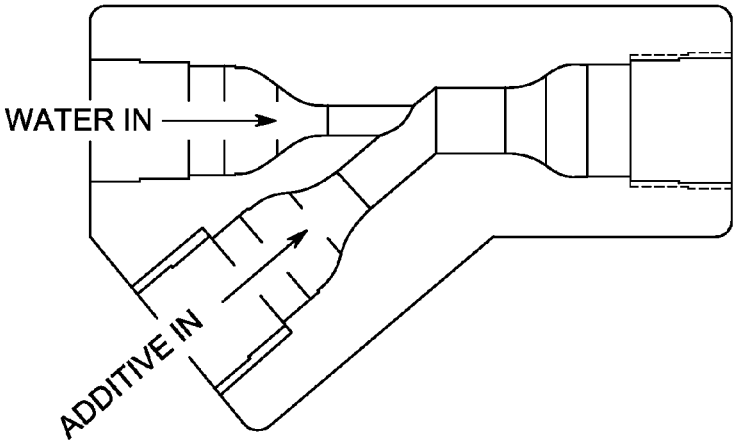
FIG. 13C presents a view of an example Venturi component, in accordance with a non-limiting example embodiment of the invention.

FIG. 13A depicts a cross-section of a typical or existing approach eductor pump. FIG. 13B depicts a photograph of a Venturi component in accordance with a non-limiting example embodiment of the invention. The Venturi component illustrated in FIG. 13B includes a piece of steel or plastic (for example, a few inches in size) with three holes. FIG. 13C depicts a cross-section of a Venturi component in accordance with a non-limiting example embodiment of the invention.

Figure 14:
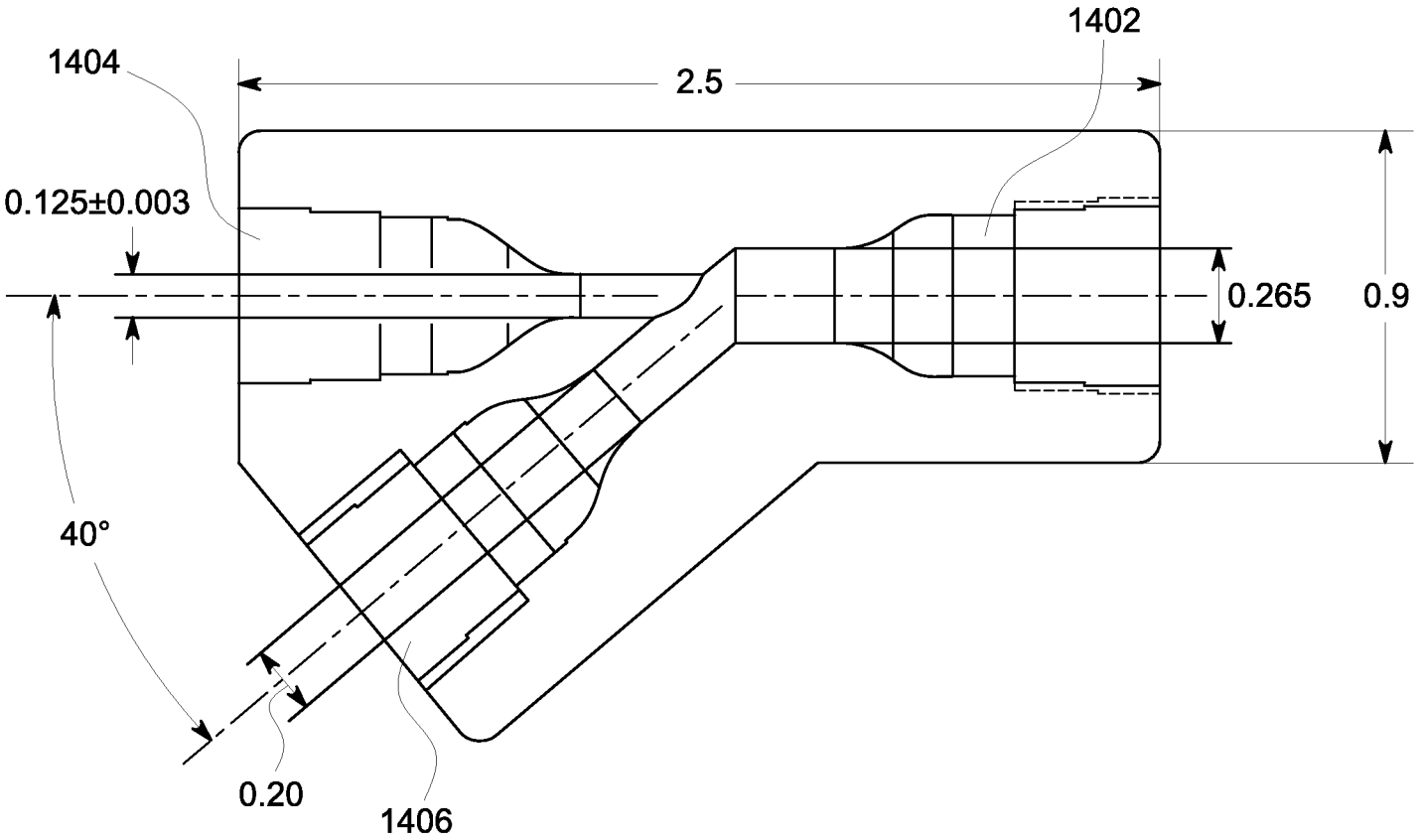
FIG. 14 presents an example Venturi component, in accordance with a non-limiting example embodiment of the invention.

FIG. 14 presents an example Venturi component, in accordance with a non-limiting example embodiment of the invention. By way of illustration, FIG. 14 depicts port 1402, port 1404 and port 1406. FIG. 14 also includes example size data of a Venturi component, according to one or more embodiments of the invention.

Figure 15:
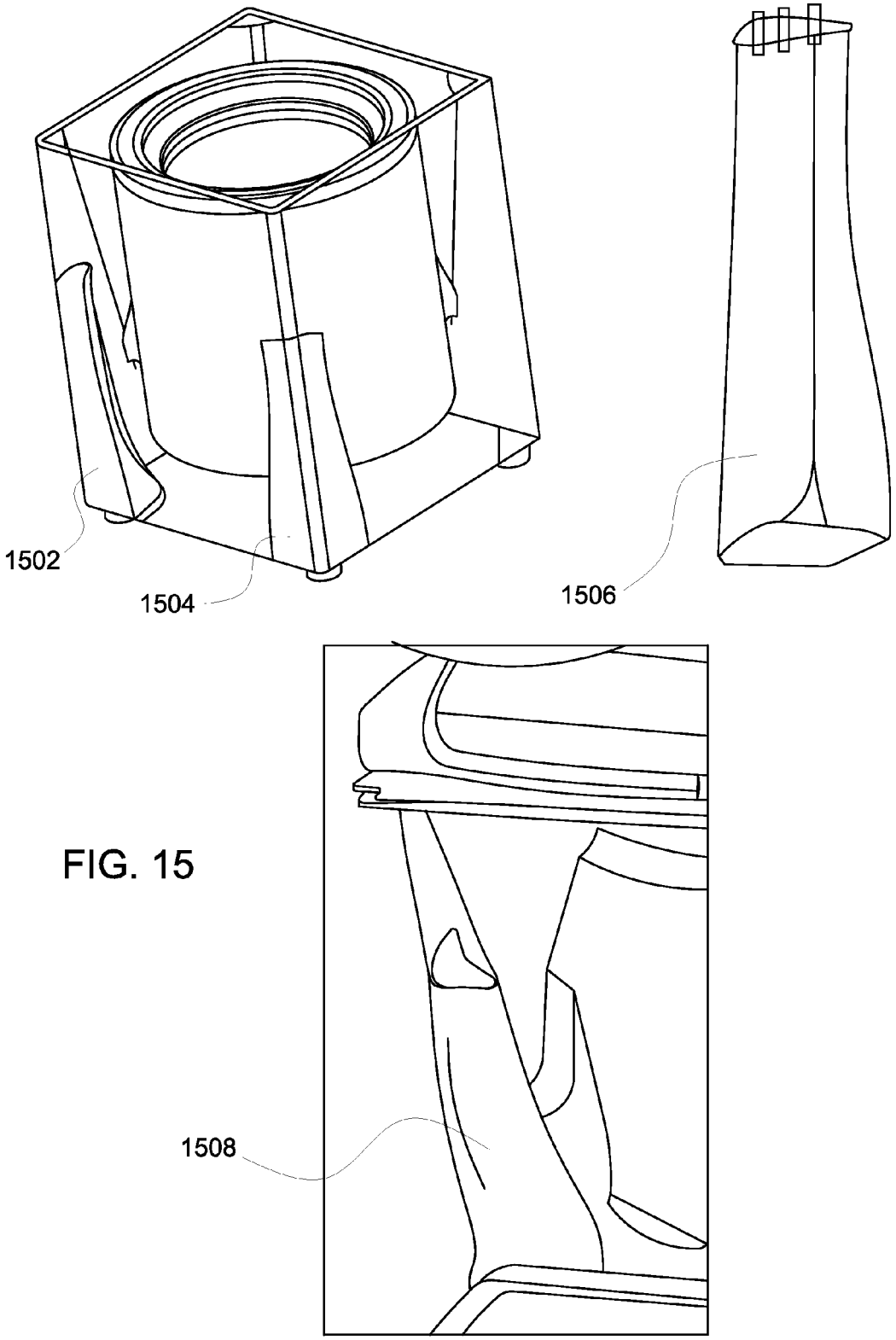
FIG. 15 presents example washing machines and tank implementations, in accordance with a non-limiting example embodiment of the invention.

FIG. 15 presents example washing machines and tank implementations, in accordance with a non-limiting example embodiment of the invention. By way of illustration, FIG. 15 depicts examples of tanks 1502 and 1504 (as seen in an example implementation as part of a washing machine), 1506 (as a stand-alone depiction), and 1508 (also as seen in an example implementation as part of a washing machine).

Figure 16:
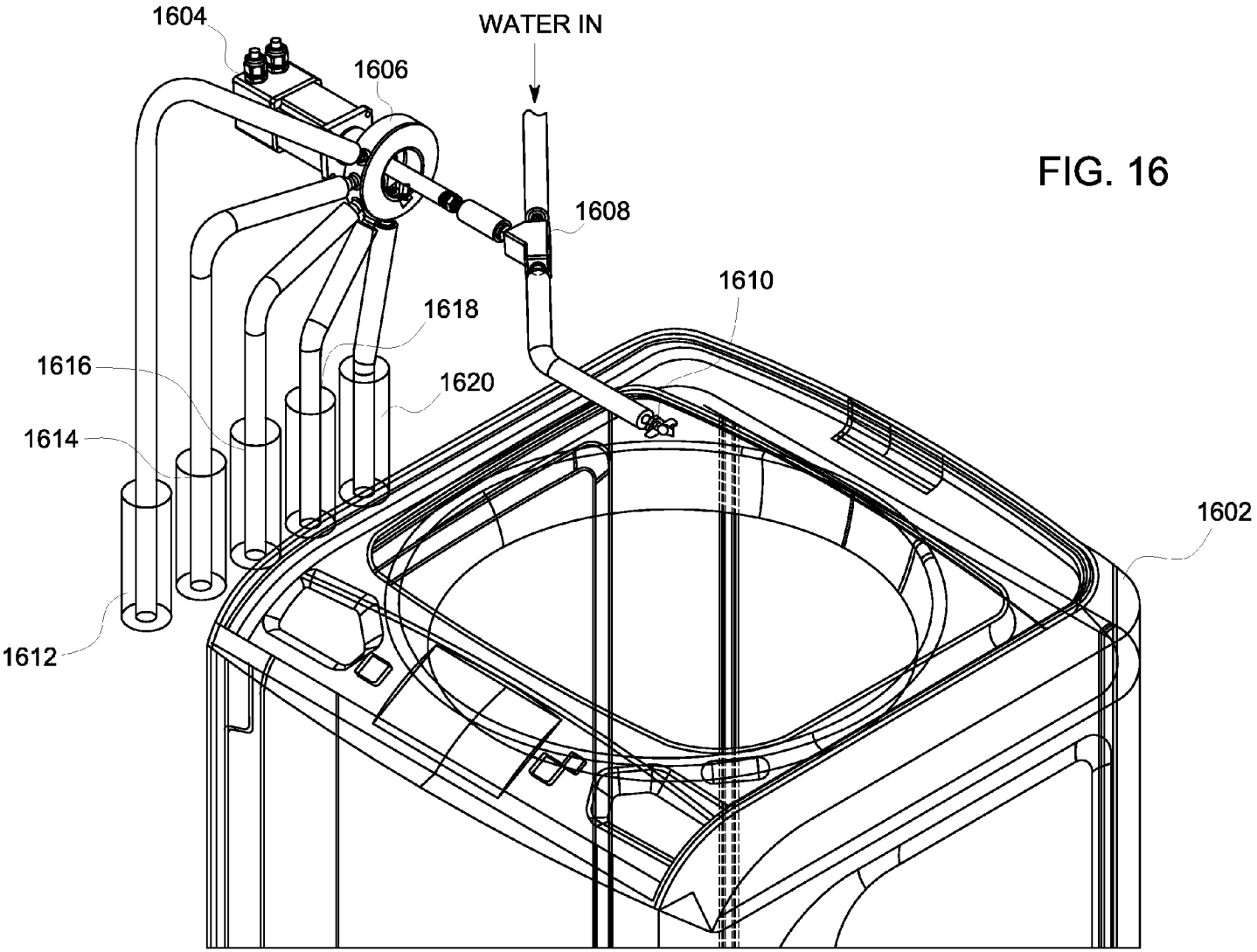
FIG. 16 presents an example vacuum diverter valve and additive tanks, in accordance with a non-limiting example embodiment of the invention.

FIG. 16 presents an example vacuum diverter valve and additive tanks, in accordance with a non-limiting example embodiment of the invention. By way of illustration, FIG. 16 depicts an example washing machine 1602, a motor 1604, a diverter valve 1606, a Venturi component 1608, a nozzle 1610 and additive tanks 1612, 1614, 1616, 1618 and 1620.

Figure 17:
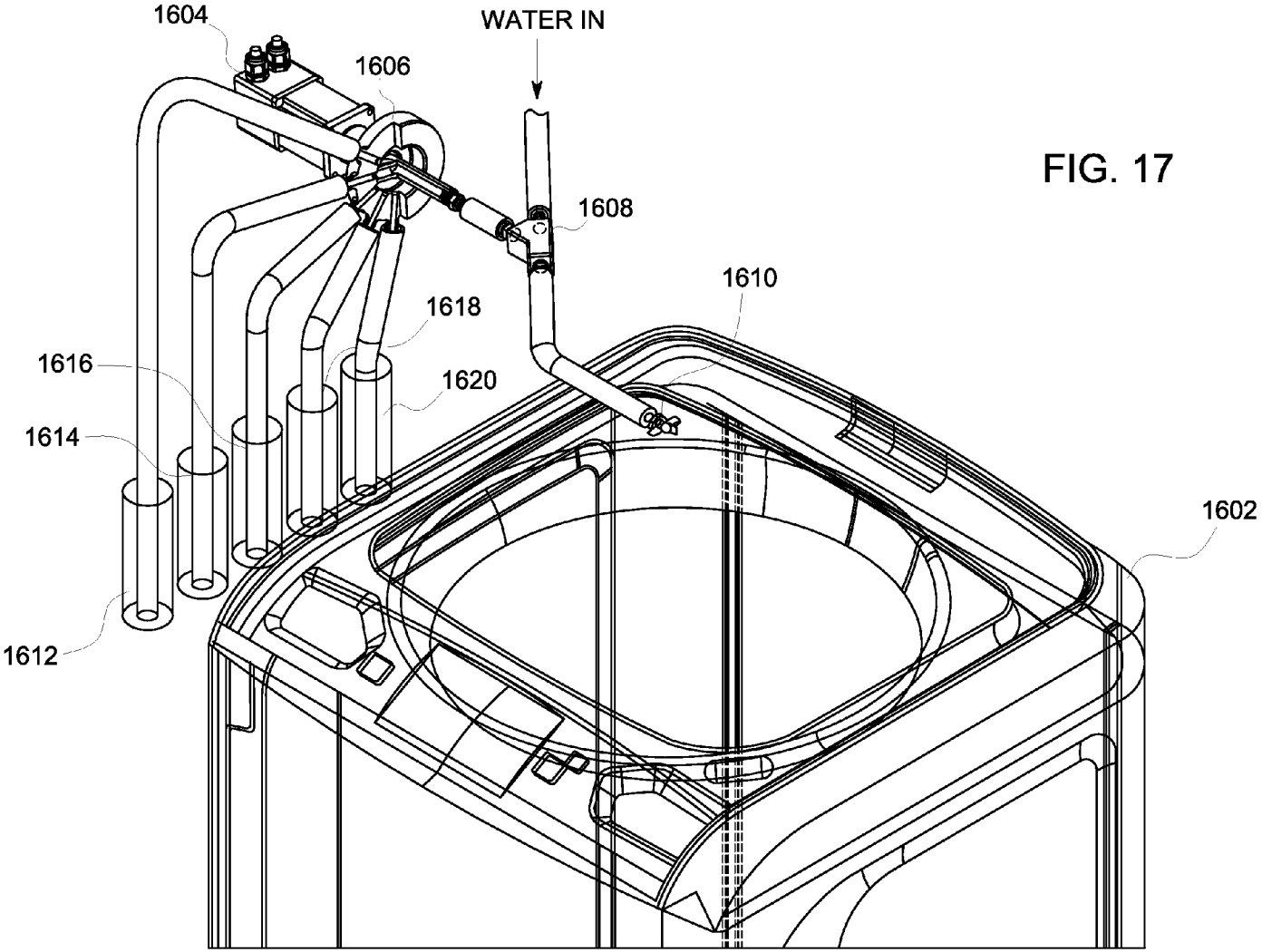
FIG. 17 presents a perspective, partially cut-off view of the example vacuum diverter valve of FIG. 16, in accordance with a non-limiting example embodiment of the invention.

FIG. 17 presents a perspective, partially cut-off view of the example vacuum diverter valve of FIG. 16, in accordance with a non-limiting example embodiment of the invention. In the position shown, the contents of tank 1614 are going to be sucked into the basket of the washing machine by the created vacuum, as detailed herein. Additionally, by way of example, an approximately 30 degree turn of the diverter valve 1606 (via the motor 1604) can cause one or more embodiments of the invention to deliver contents from tank 1612 or tank 1616, depending on the direction of rotation.

Figure 18B:
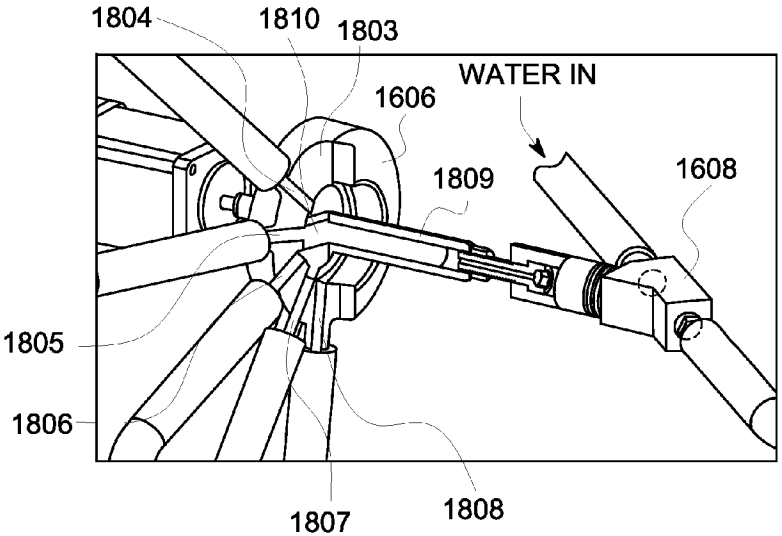
FIG. 18B presents a view of the connection between the diverter valve and the Venturi component of FIG. 16, in accordance with a non-limiting example embodiment of the invention.
Figure 18A:
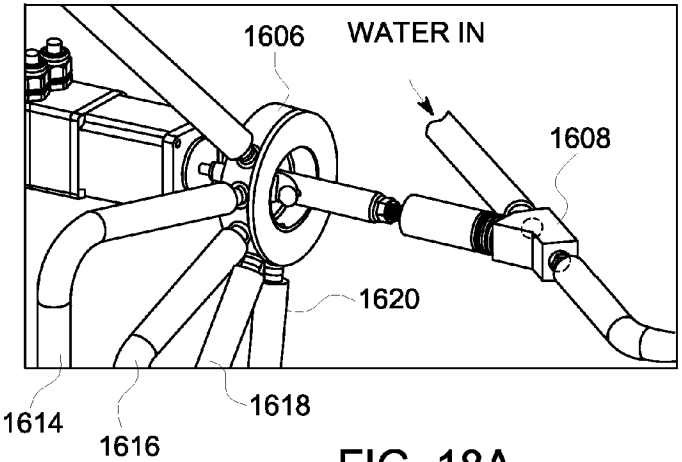
FIG. 18A presents a view of the connection between the diverter valve and the Venturi component of FIG. 16, in accordance with a non-limiting example embodiment of the invention.
Figure 18C:
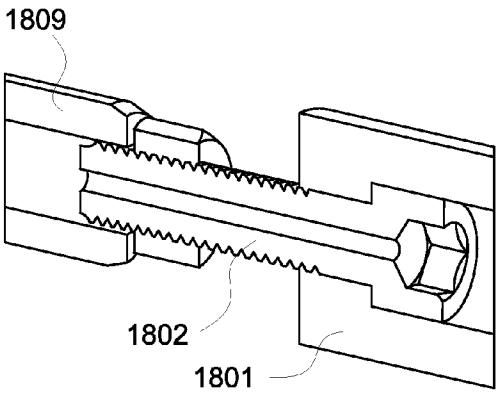
FIG. 18C presents a view of the connection between the diverter valve and the Venturi component of FIG. 16, in accordance with a non-limiting example embodiment of the invention.

FIG. 18A, FIG. 18B and FIG. 18C, depict progressive close-up and partially cut-off views of the connection between Venturi component 1608 and diverter valve 1606. As illustrated in FIG. 18C, sleeve 1801 is rigidly affixed to Venturi component 1608 (that is, sleeve 1801 does not move relative to the Venturi component) and conductor 1802 of the diverter valve can rotate relative to sleeve 1801. Also, there is a sealing mechanism (not shown) between sleeve 1801 and conductor 1802. In one or more embodiments of the invention, additive, suctioned up from the selected tank via a created vacuum, passes inside the hole in conductor 1802 of the diverter valve, then inside the hole in the sleeve 1801 and mixes with motif fluid (for example, water) in the Venturi component 1608, at which point that mixture is sent into the basket of the washing machine.

Further, in one or more embodiments of the invention, the diverter valve 1606 includes a housing 1803 that contains channeling (such as, for example, channels 1804, 1805, 1806, 1807 and 1808), with the channels lining up with a tube or pipe connected to a particular tank (depending on the desired selection). The channeling facilitates directing fluid (via vacuum flow) from a selected tank into pipe 1809, wherein the fluid can then, for example, pass inside the hole in conductor 1802 of the diverter valve to the inside the hole in the sleeve 1801. As detailed herein, sleeve 1801 is affixed to Venturi component 1608 while conductor 1802 of the diverter valve (connected to pipe 1809) can rotate relative to sleeve 1801, thereby opting to utilize different diverter valve housing channel-tank pipe connections. Also as noted, sleeve 1801 and conductor 1802 are joined, in one or more embodiments of the invention, via a sealing mechanism.

The rotating of the diverter valve is actuated by a motor 1604 which, described herein, is controlled by machine control board/microprocessor. The electrical motor for rotating a nozzle 1810 of the diverter valve to selectively establish flow connection with at least one of the multiple locations (via utilization of the housing channels).

As detailed herein, for dispensing purposes, additive, suctioned up from a selected tank via a created vacuum, passes through pipe 1809 inside the hole in conductor 1802, and then inside the hole in the sleeve 1801 and mixes with motif fluid (for example, water) in the Venturi component 1608, at which point that mixture is sent into the basket of the washing machine. For cleaning purposes, water passing through the Venturi component 1608 creates a vacuum which can be diverted by diverter valve 1606 into one of multiple tanks with additives. Additionally, for example, a diverter valve position can connect to inlet water to provide a purge position to an orifice, preventing undesired dispensing.

Figure 19:
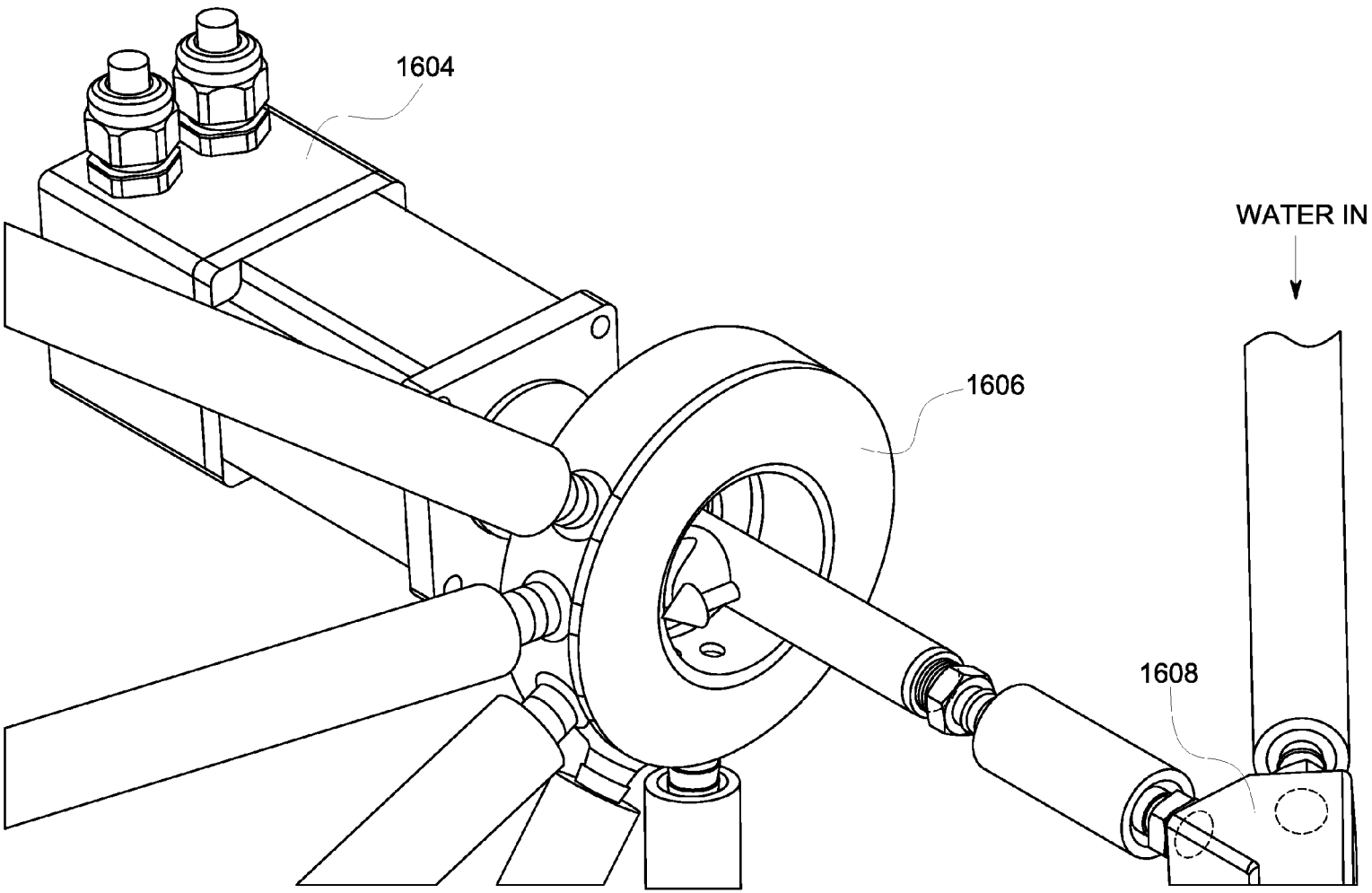
FIG. 19 presents an example vacuum diverter valve, in accordance with a non-limiting example embodiment of the invention.

FIG. 19 presents an example vacuum diverter valve, in accordance with a non-limiting example embodiment of the invention. By way of illustration, FIG. 19 depicts a motor 1604, a diverter valve 1606 and a Venturi component 1608. Water passing through the Venturi component 1608 creates a vacuum which can be diverted by diverter valve 1606 into one of multiple containers with additives. The diverter valve is actuated by a motor 1604 which, in turn, is controlled by machine control board/microprocessor (as detailed herein). Additionally, as depicted in FIG. 19, the arrow is merely descriptive in that it is an indication of which tank is being accessed (that is, which tank the vacuum diverter valve is suctioning contents from) in the configuration illustrated in FIG. 19.

Figure 20:
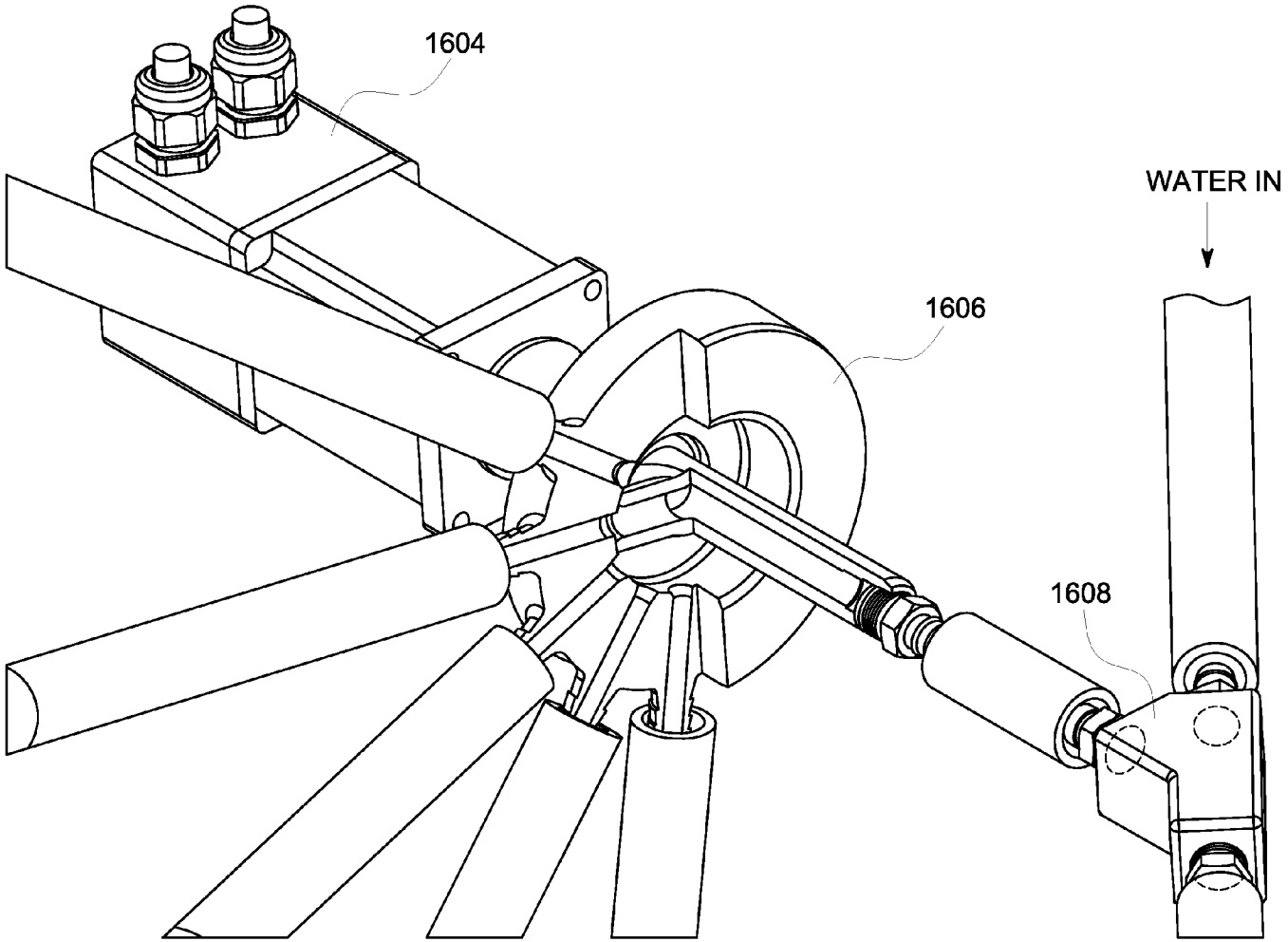
FIG. 20 is a perspective, partially cut-off view of the example vacuum diverter valve of FIG. 19, in accordance with a non-limiting example embodiment of the invention.

FIG. 20 is a perspective, partially cut-off view of the example vacuum diverter valve of FIG. 19, in accordance with a non-limiting example embodiment of the invention. By way of illustration, FIG. 20 depicts a motor 1604, a diverter valve 1606 and a Venturi component 1608.

As detailed herein, one or more embodiments of the invention can additionally include a diverter valve with an integral Venturi component to dispense from/to multiple locations. Washers that dispense multiple fabric care products use many solenoid valves that wash/rinse out the detergent/additive(s) to accomplish this task. Each solenoid can potentially be both costly and represent a failure point. As such, one or more embodiments of the invention include using fewer, for example a single, solenoid/diverter valve(s) with an integral Venturi component to accomplish this task with fewer parts and less cost and complexity.

The Venturi component creates a siphon that sucks-in the product to be delivered into the valve and then into to the wash container. In one or more embodiments of the invention, implementing the Venturi component as a feature of a diverter valve allows the valve to draw from one of multiple places. Dispensing in this fashion can eliminate water valves while providing the ability to dispense from multiple locations. By way of example, one of the diverter valve positions can connect to inlet water to provide a purge position to the orifice, preventing mixing of incompatible materials or incorrectly dispensing residual additives during the incorrect portion of the cycle.

Flow through a Venturi component can create a siphon. One or more embodiments of the invention can include adding a Venturi component orifice to a diverter valve. The diverter valve could be fluidly coupled to the dispense sources on a washer, and this would yield a simple system with a large amount of flexibility. Multiple dispense options lead to large quantities of valves, tubing, and etc. This design reduces the complexity of the system while maintaining complete flexibility.

Figure 21:
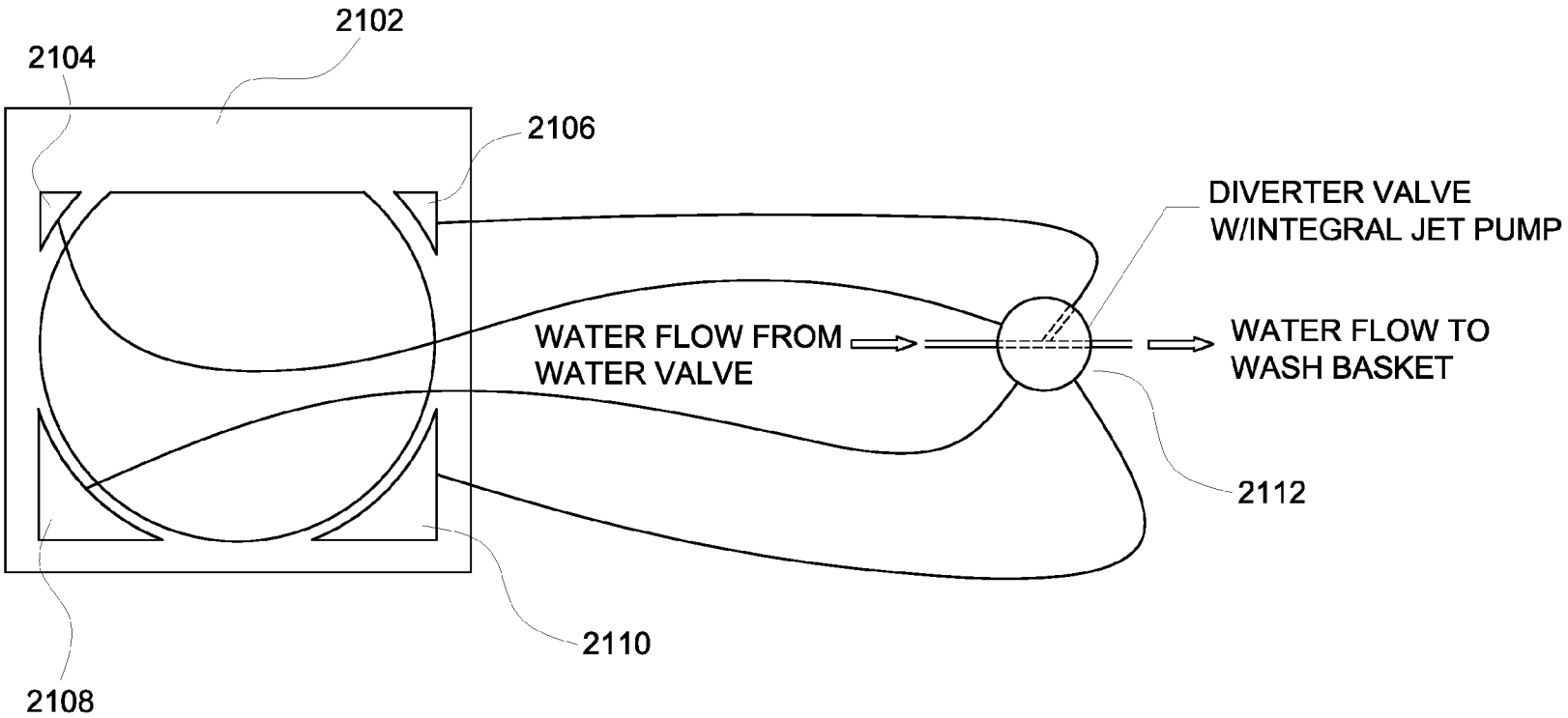
FIG. 21 presents a top view of an example vertical axis washing machine, in accordance with a non-limiting example embodiment of the invention.

FIG. 21 presents a top view of an example vertical axis washing machine, in accordance with a non-limiting example embodiment of the invention. By way of illustration, FIG. 21 depicts a top view of a washing machine 2102, with cups 2104, 2106, 2108 and 2110, as well as diverter valve 2112. As illustrated in FIG. 21, a washer can have multiple additive locations, A (2104), B (2106), C (2108), and D (2110), all of which are fluidically coupled to the diverter valve 2112.

If, by way of example, the system in FIG. 21 depicted a flow-through dispenser, when the fill cup A (2104), in this example, is coupled to the Venturi component feature in the diverter valve, and the fill valve is actuated, the contents of additive compartment A flows through the diverter valve and into the wash compartment. So on for B, C, D, etc.

As described herein, a diverter valve can connect two or more tanks to a Venturi component. A diverter valve can include an electrical motor that moves a nozzle, directing vacuum flow from A to B to C and so on. A Venturi component creates a vacuum, and then this vacuum can be directed into different locations via the diverter valve. As noted herein, a Venturi component has three holes: inlet, outlet and additive. By way of example, now imagine that the additive hole has a connection with four other holes—that is, there are four pipes feeding into the additive hole. As such, between the four pipes and one Venturi component inlet, one or more embodiments of the invention can include a switch and/or electrical motor that open(s) a pipe or pipes in a sequence.

As illustrated in FIG. 21, one example for a flow-through dispenser (that is, a single use dispenser) can include having four cups available in the top cover of the washing machine. Accordingly, a user can lift up the lid of the machine and see the access hole where the clothes go in, and the four cups found, for example, in the corners. In one or more embodiments of the invention, there can be one hose that goes to a cup, and would be running water there and pulling fluid out through the Venturi component. In such an embodiment, with four cups, there would be four such arrangements. Also, in one or more embodiments of the invention, there can be a hose that connects to each of the cups and goes to the diverter valve, and there can be one suction point out of the diverter valve. This can be, for example, something that looks like a cylinder with holes in it that line up. Note, also, that a four-cup configuration is simply an example for purposes of illustration. It should be appreciated that different configurations with differing numbers of cups could be implemented with one or more embodiments of the invention. Further, the diverter valve concept applies to and can be implemented with both bulk and flow-through dispensers.

One advantage that may be realized in the practice of some embodiments of the described systems and techniques is implementing an additive dispenser with a Venturi component tube to provide a Venturi effect which mixes water and detergent to supply it to a washing machine. Another advantage that may be realized in the practice of some embodiments of the described systems and techniques is enabling self-cleaning of a dispenser via control of the valves. Yet another advantage of one or more embodiments of the invention is that the two valve configuration allows a user to clean out the tank without having to take the tanks out (that is, remove the tank(s)).

Figure 22:
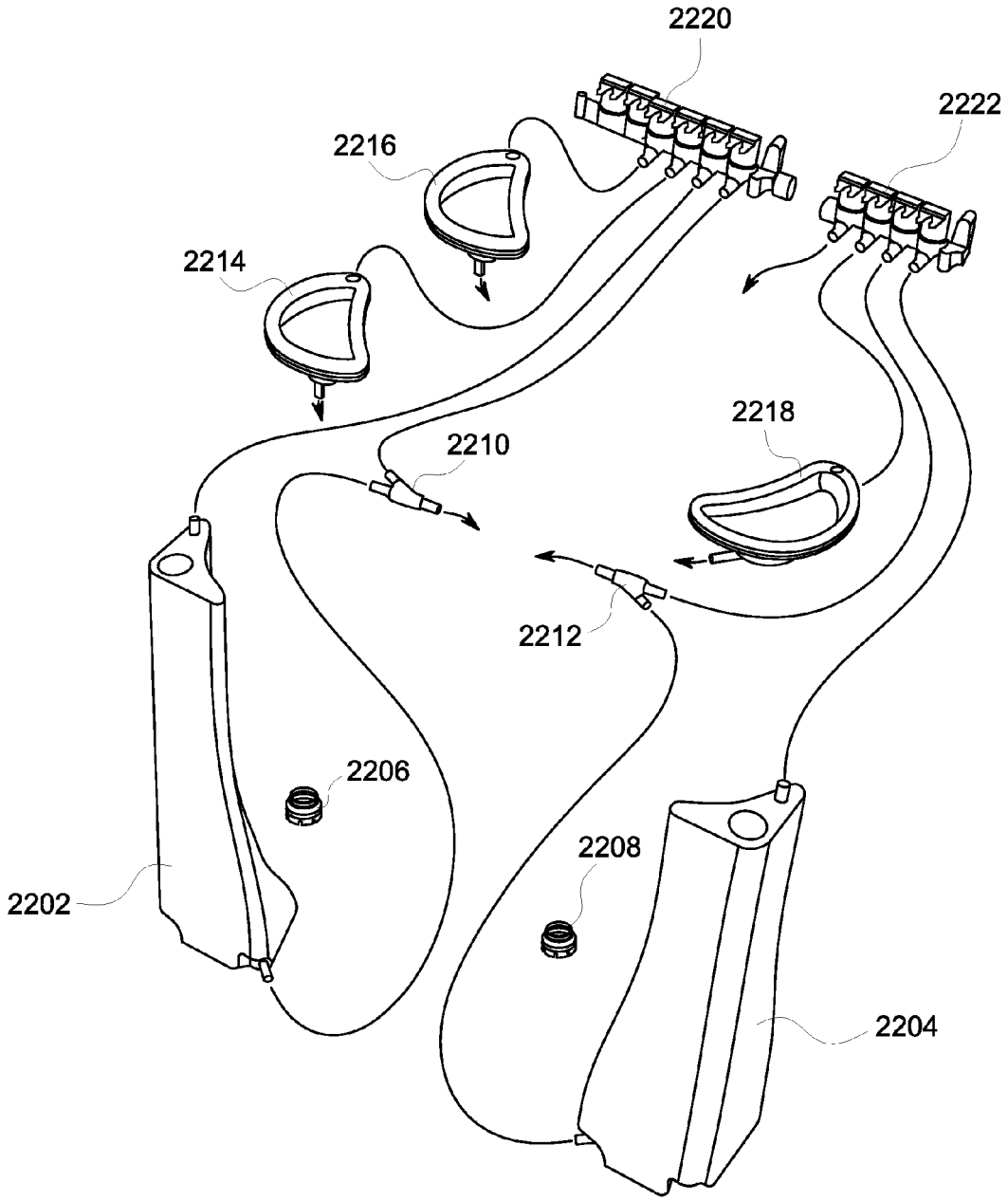
FIG. 22 presents dispense systems, in accordance with a non-limiting example embodiment of the invention.

FIG. 22 presents dispense systems, in accordance with a non-limiting example embodiment of the invention. By way of illustration, FIG. 22 depicts detergent storage tank 2202, which connects to aspirator/Venturi component 2210 and water valves 2220. Water valves 2220 feed into jet cups 2214 and 2216. Also, pressure sensor 2206 feeds input to controls. As also depicted in FIG. 22, fabric softener storage tank 2204 connects to aspirator/Venturi component 2212 and water valves 2222. Water valves 2222 feed into jet cup 2218. Also, pressure sensor 2208 feeds input to controls.

Figure 23:
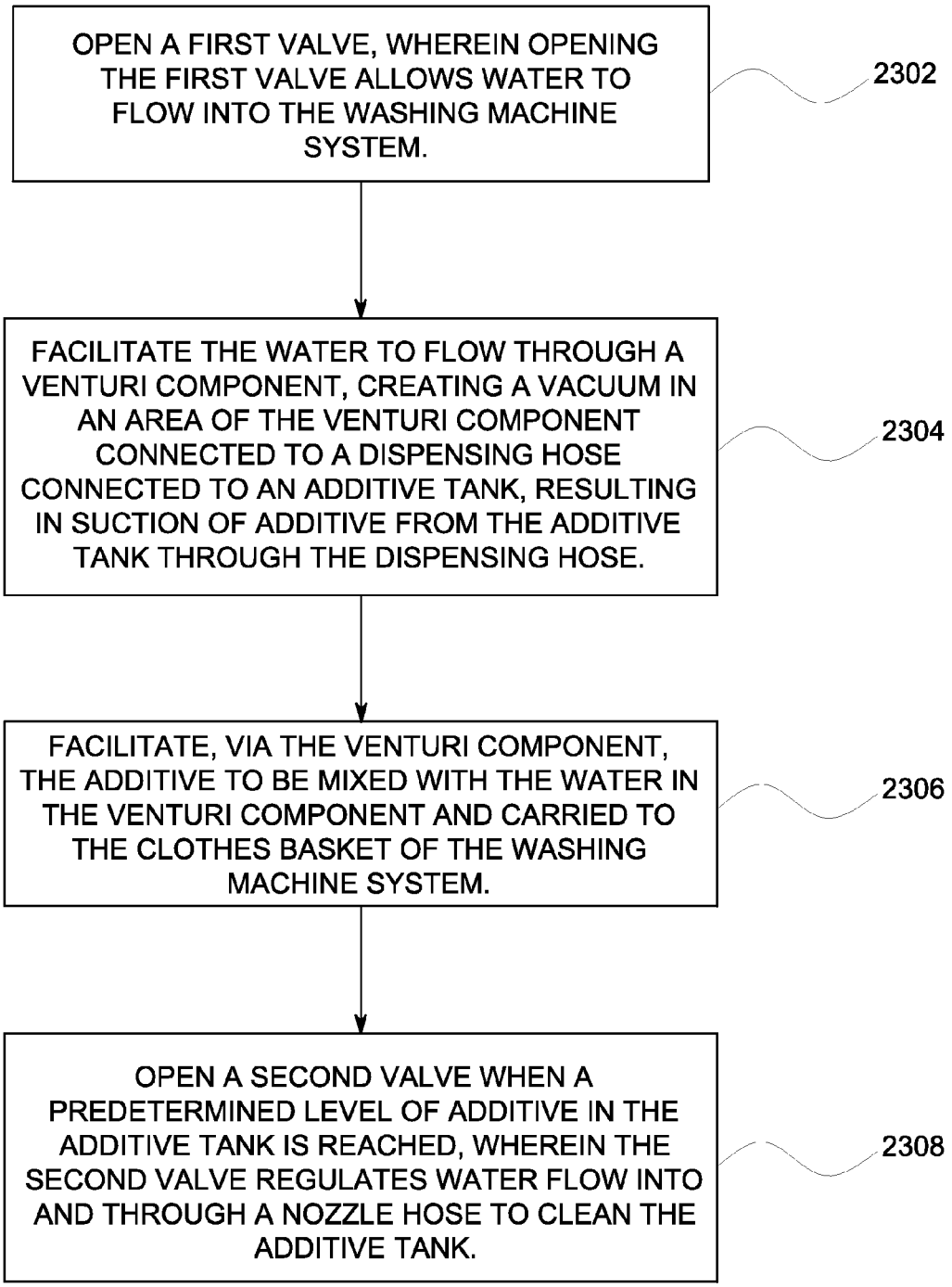
FIG. 23 is a flow chart of a method of operating a washing machine system, in accordance with a non-limiting example embodiment of the invention.

Reference should now be had to the flow chart of FIG. 23. FIG. 23 is a flow chart of a method of operating a washing machine system, in accordance with a non-limiting example embodiment of the invention. Step 2302 includes opening a first valve, wherein opening the first valve allows water to flow into the washing machine system. Step 2304 includes facilitating the water to flow through a Venturi component, creating a vacuum in an area of the Venturi component connected to a dispensing hose connected to an additive tank, resulting in suction of additive from the additive tank through the dispensing hose.

Step 2306 includes facilitating, via the Venturi component, the additive to be mixed with the water in the Venturi component and carried to a clothes basket of the washing machine system. Step 2308 includes opening a second valve when a predetermined level of additive in the additive tank is reached, wherein the second valve regulates water flow into and through a nozzle hose to clean the additive tank.

As illustration, for example in FIG. 6, one or more embodiments of the invention can include two different systems. To clean system 1, the second valve needs to be closed. To clean system2, the second valve needs to be open. This is further illustrated, for example, in FIG. 9 and FIG. 12.

As detailed herein, one or more embodiments of the invention can be implemented in a washing machine system that includes a flow-through dispenser or a bulk dispenser, a top-loaded machine or a front-loaded machine. Further, the above-noted steps can be performed automatically by the washing machine system every time the container becomes empty and/or performed after manual activation by a user via sending one or more signals from a control.

Also, the techniques depicted in FIG. 23 can additionally include implementing one or more combinations of open and closed states for the first valve and second valve to perform desired cleaning of the washing machine system. For example, in one or more embodiments of the invention, the first valve remains open when the second valve is open to drain out waste-water simultaneously with cleaning of the container. In another example, the first valve immediately closes when the second valve opens to provide time to clean all areas of the additive container, and the first valve opens after a specified duration of time to remove waste-water from the container.

Furthermore, given the discussion thus far, it will be appreciated that, in general terms, an example apparatus, according to still another aspect of the invention, includes a clothes basket 112 rotatable about an axis 28; a motor 108 coupled to the clothes basket; an additive tank; a Venturi component, wherein the Venturi component comprises a hole connecting to a water inlet, a hole connecting to the additive tank, and a hole connecting to the clothes basket; a first valve, wherein the first valve is located between the water inlet and the Venturi component; and a second valve, wherein the second valve is located, in one embodiments of the invention, between the Venturi component and the clothes basket and, in another embodiments of the invention, between the water inlet and the additive tank; and a processor (e.g., microprocessor 116 or alternative) coupled to the first valve and the second valve. The processor is operative to control the motor to implement one or more techniques as described herein such as, for example, carry out a dispensing phase of the apparatus and carry out a self-cleaning phase of the apparatus. The axis 28 can have any orientation; in some cases, such as FIGS. 2 and 3, it may be substantially vertical; in other cases, such as FIGS. 4 and 5, it may be substantially horizontal (for example, machines that are perfectly horizontal as well as machines that have a slight tilt and are not perfectly horizontal). Such an example apparatus can additionally include a liquid level sensor configured to sense a level of additive in the additive tank.

The apparatus can additionally include a diverter valve to dispense from and to multiple locations, and an electrical motor for rotating a nozzle of the diverter valve to selectively establish flow connection with at least one of the multiple locations. Additionally, the apparatus can include one or more flow restrictions (for example, elbows) to create back pressure in the apparatus.

As also detailed herein, one or more embodiments of the invention can include an apparatus that comprises a Venturi component for use in a washing machine apparatus, wherein the component comprises a water inlet hole, wherein the water inlet hole connects to a water inlet of the washing machine apparatus, an additive inlet hole, wherein the additive inlet hole connects to an additive tank, and an outlet hole, wherein the outlet hole connects to a clothes basket of the washing machine apparatus, wherein water flows through the water inlet hole, creating a vacuum in the additive inlet hole, resulting in suction of additive from the additive tank which mixes with the water passing through the water inlet hole and is carried through the outlet hole to the clothes basket of the washing machine apparatus. By way of example, use in a washing apparatus can include a cleanout mechanism and/or a dispensing mechanism for a flow-through dispenser, as detailed herein.

Figure 24:
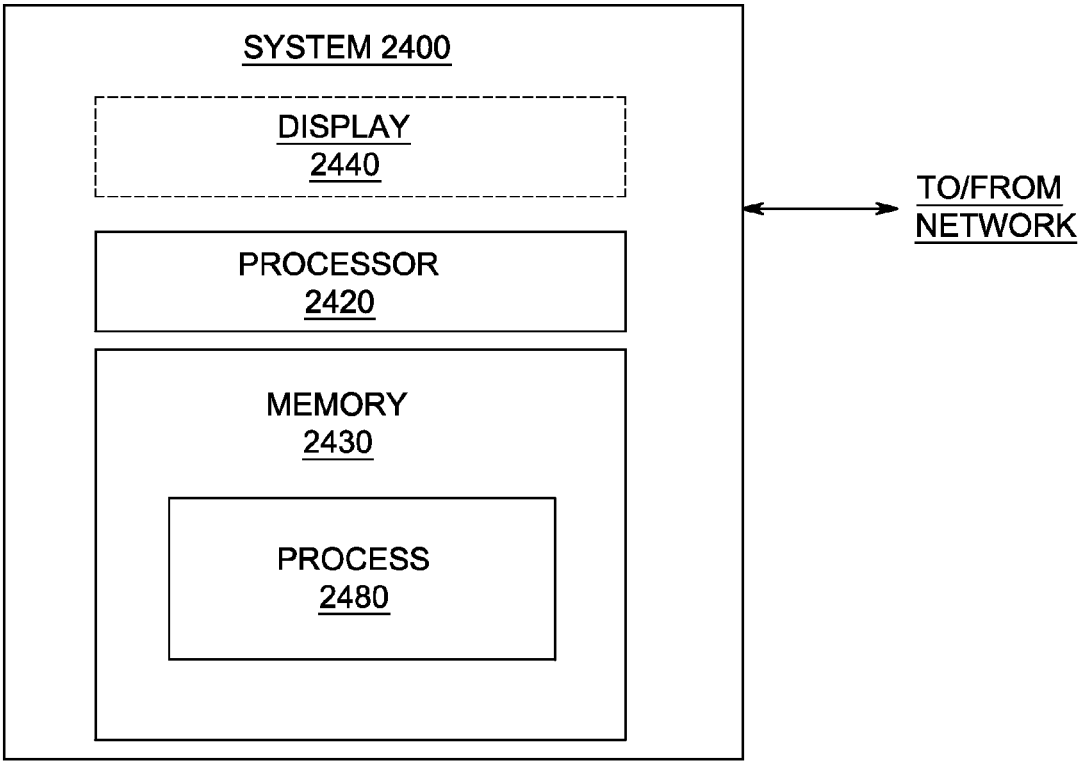
FIG. 24 is a block diagram of an example computer system useful in connection with one or more embodiments of the invention.

Aspects of the invention (for example, microprocessor 116 or other computer system to carry out design methodologies) can employ hardware and/or hardware and software aspects. Software includes but is not limited to firmware, resident software, microcode, etc. FIG. 24 is a block diagram of a system 2400 that can implement part or all of one or more aspects or processes of the invention. As shown in FIG. 24, memory 2430 configures the processor 2420 to implement one or more aspects of the methods, steps, and functions disclosed herein (collectively, shown as process 2480 in FIG. 24). Different method steps could theoretically be performed by different processors. The memory 2430 could be distributed or local and the processor 2420 could be distributed or singular. The memory 2430 could be implemented as an electrical, magnetic or optical memory, or any combination of these or other types of storage devices. It should be noted that if distributed processors are employed (for example, in a design process), each distributed processor that makes up processor 2420 generally contains its own addressable memory space. It should also be noted that some or all of computer system 2400 can be incorporated into an application-specific or general-use integrated circuit. For example, one or more method steps could be implemented in hardware in an application specific integrated circuit rather than using firmware. Display 2440 is representative of a variety of possible input/output devices.

As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer (e.g., processor 116) to read instructions and data, such as magnetic variations on a magnetic media or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal. Processor 116 may include and/or be coupled to a suitable memory.

The computer system can contain a memory that will configure associated processors to implement the methods, steps, and functions disclosed herein. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor. With this definition, information on a network is still within a memory because the associated processor can retrieve the information from the network.

Accordingly, it will be appreciated that one or more embodiments of the present invention can include a computer program comprising computer program code means adapted to perform one or all of the steps of any methods or claims set forth herein when such program is run on a computer, and that such program may be embodied on a computer readable medium. Further, one or more embodiments of the present invention can include a computer comprising code adapted to cause the computer to carry out one or more steps of methods or claims set forth herein, together with one or more apparatus elements or features as depicted and described herein.

It will be understood that processors or computers employed in some aspects may or may not include a display, keyboard, or other input/output components. As such, one or more embodiments of the invention utilize a processor or a computer to control processes, operate water valves, etc., and in one or more embodiments of the invention, special programming is used and/or added to carry out the techniques detailed herein.

Thus, while there have shown and described and pointed out fundamental novel features of the invention as applied to example embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:

a clothes basket rotatable about an axis;

a motor coupled to the clothes basket;

an additive tank;

a liquid level sensor configured to determine a level of additive in the additive tank;

a Venturi component having a first hole fluidly connecting to a water inlet, a second hole fluidly connecting to the additive tank, and a third hole fluidly connecting to the clothes basket;

a first valve located between the water inlet and the Venturi component;

a second valve located between the Venturi component and the clothes basket; and a processor coupled to the first valve and the second valve, the processor being configured to:

carry out a dispensing phase of the apparatus by opening the first valve and opening the second valve so as to create a vacuum in an area where the Venturi component is connected to the additive tank resulting in suction of additive from the additive tank to the clothes basket; and carry out a self-cleaning phase of the apparatus by:

opening the first valve and closing the second valve responsive to the liquid level sensor determining that the level of additive in the additive tank reaches a predetermined level so as to wash the additive tank; and opening the second valve after a specified duration of time so as to create the vacuum in the area where the Venturi component is connected to the additive tank resulting in suction of waste-water from the additive tank to the clothes basket.

2. The apparatus of claim 1, wherein the axis comprises one of a substantially vertical axis and a substantially horizontal axis.

3. The apparatus of claim 1, further comprising a diverter valve to dispense from and to multiple locations, and an electrical motor for rotating a nozzle of the diverter valve to selectively establish flow connection with at least one of the multiple locations.

4. The apparatus of claim 1, further comprising one or more flow restrictions to create back pressure in the apparatus.

5. The apparatus of claim 1, wherein the processor is further configured to carry out a default phase of the apparatus, wherein in carrying out the default phase, the processor is further configured to close the first valve and close the second valve to prevent water from flowing through the apparatus.

6. The apparatus of claim 1, wherein in carrying out the dispensing phase, the suction of the additive from the additive tank comprises suction of the additive into the Venturi component, where the additive mixes with a water flow, wherein the additive is transferred, via the water flow, out of the Venturi component to the clothes basket.

7. The apparatus of claim 1, wherein the second hole is fluidly connected to the additive tank through a dispensing hose, and wherein in carrying out the self-cleaning phase, water flows into the additive tank through the dispensing hose and the waste-water is removed from the additive tank via the vacuum created by the Venturi component.

8. The apparatus of claim 7, wherein the processor is further configured to close the second valve after the waste-water has been removed from the additive tank to refill the additive tank with water to repeat the self-cleaning phase to a desired level of cleanliness.

9. An apparatus comprising:

a clothes basket rotatable about an axis;

a motor coupled to the clothes basket;

an additive tank;

a liquid level sensor configured to determine a level of additive in the additive tank;

Venturi component having a first hole fluidly connecting to a water inlet, a second hole fluidly connecting to the additive tank, and a third hole fluidly connecting to the clothes basket;

a first valve located between the water inlet and the Venturi component;

a second valve located between the water inlet and the additive tank; and a processor coupled to the first valve and the second valve, the processor being configured to:

carry out a dispensing phase of the apparatus by opening the first valve so as to create a vacuum in an area where the Venturi component is connected to the additive tank resulting in suction of additive from the additive tank to the clothes basket; and carry out a self-cleaning phase of the apparatus by:

opening the second valve responsive to the liquid level sensor determining that the level of the additive in the additive tank reaches a predetermined level so as to wash the additive tank; and opening the first valve after a specified duration of time so as to create the vacuum in the area where the Venturi component is connected to the additive tank resulting in suction of waste-water from the additive tank to the clothes basket.

10. The apparatus of claim 9, wherein the axis comprises one of a substantially vertical axis and a substantially horizontal axis.

11. The apparatus of claim 9, further comprising a diverter valve to dispense from and to multiple locations, and an electrical motor for rotating a nozzle of the diverter valve to selectively establish flow connection with at least one of the multiple locations.

12. The apparatus of claim 9, further comprising one or more flow restrictions to create back pressure in the apparatus.

13. The apparatus of claim 9, wherein the processor is further configured to carry out a default phase of the apparatus, wherein in carrying out the default phase, the processor is further configured to close the first valve and close the second valve to prevent water from flowing through the apparatus.

14. The apparatus of claim 9, wherein in carrying out the dispensing phase, the suction of the additive from the additive tank comprises suction of the additive into the Venturi component where the additive mixes with a water flow, wherein the additive is transferred, via the water flow, out of the Venturi component to the clothes basket.

15. The apparatus of claim 9, wherein in carrying out the self-cleaning phase, water flows into the additive tank through a dispensing hose and the waste-water is removed from the additive tank via the vacuum created by the Venturi component.

* * * * *